US009251664B2

(12) United States Patent
Ditchev

(10) Patent No.: US 9,251,664 B2
(45) Date of Patent: Feb. 2, 2016

(54) CASINO SLOT WAGERING SYSTEM

(71) Applicant: Dimo Ditchev, Reno, NV (US)

(72) Inventor: Dimo Ditchev, Reno, NV (US)

( * ) Notice: Subject to any disclaimer, the term of this patent is extended or adjusted under 35 U.S.C. 154(b) by 0 days.

(21) Appl. No.: 13/632,557

(22) Filed: Oct. 1, 2012

(65) Prior Publication Data

US 2013/0084931 A1 Apr. 4, 2013

Related U.S. Application Data

(63) Continuation-in-part of application No. 12/454,901, filed on May 26, 2009, now Pat. No. 8,277,299.

(51) Int. Cl.
*G07F 17/32* (2006.01)
*G07F 17/34* (2006.01)

(52) U.S. Cl.
CPC ..... *G07F 17/3293* (2013.01); *G07F 17/3225* (2013.01); *G07F 17/3244* (2013.01); *G07F 17/34* (2013.01)

(58) Field of Classification Search
CPC ..... A63F 2001/005; G07F 17/3293
USPC ..... 463/13
See application file for complete search history.

(56) References Cited

U.S. PATENT DOCUMENTS

| | | | | |
|---|---|---|---|---|
| 5,823,873 | A * | 10/1998 | Moody | 463/13 |
| 5,868,618 | A * | 2/1999 | Netley et al. | 463/13 |
| 6,050,568 | A * | 4/2000 | Hachquet | 273/292 |
| 2002/0183105 | A1 * | 12/2002 | Cannon et al. | 463/16 |
| 2003/0064768 | A1 * | 4/2003 | Fier | 463/13 |
| 2005/0085285 | A1 * | 4/2005 | Muskin | 463/13 |
| 2006/0073884 | A1 * | 4/2006 | Walker et al. | 463/25 |

* cited by examiner

*Primary Examiner* — Paul A D'Agostino
*Assistant Examiner* — Ankit Doshi
(74) *Attorney, Agent, or Firm* — Knechtel, Demeur & Samlan

(57) ABSTRACT

A method and apparatus for casino slot games in which at least two and preferably three games are linked together by displaying the two or three games on one video display device. The games are linked through the initial cards displayed for each game, and their bets and their outcomes. A computer calculates the probabilities of all bets and outcomes during the betting rounds in real time. As a result of the so chained games the player makes decisions in multiple betting rounds in insufficient information about the game outcomes. At any time during the game play the player can evaluate the game outcomes as presented to him by the computer and either play the next successive game or simply finish the game with no penalty.

19 Claims, 20 Drawing Sheets

CASINO SLOT WAGERING SYSTEM

CROSS REFERENCE TO RELATED APPLICATION

This application is a continuation in part of Ser. No. 12/454,901 filed May 26, 2009 now U.S. Pat. No. 8,277,299.

I. BACKGROUND OF THE INVENTION

The history of slot machines as amusement devices dates back to 1897 when Charlie Fey, a car mechanic from San Francisco, invented "Liberty Bell". He used it to entertain his customers while they were waiting for their cars being repaired at his shop. Several new companies, by making mechanical slot machines with similar design, gave the birth of a new fast growing industry. But the gambling aspect of these gambling primates was limited due to the physical limitation on the number of symbols and fairly easiness to cheat, therefore the rather small jackpots.

In 1964 the slot machines turned into a business device also. By replacing the mechanical parts of the slot machine with electronic parts Bally Manufacturing added two more dimensions to slot machines: the coins in and coins out. Unlike their mechanical counterparts the computers were no subject to wear and tear. The results from their operation became highly reliable and predictable. From fringe pastime offering placed around the edges of the casinos for the companions of the gamblers while they were playing at the tables, the slot machines were moved to the center of the casino. By the mid 70's they dominated the casinos by generating about three quarters of the casino revenue.

Video poker became very popular as a slot game in the late 70's. The dimension of the optimal play was added. Players were able to make decisions and chose among different alternative strategies. Its popularity grew so much in the early 90's that earned it the name the "America's National Game of Chance".

The progressive systems in the 80's added another dimension to the slot machines by virtually linking many slot machines very often in different casinos and physical areas into one common pool. By playing at any one of these slot machines the players were contributing a dismal portion of their bet into a jackpot with unperceivable before size and were competing for it. The technological innovations in the computer science elevated the physical restriction in the size of the reels and provided analyses on the outcomes by computer simulation.

The design of the multi-game in the early 90's gave the player the ability to choose among different games at the same slot machines and added multiple dimensions to the slot machines. Now the same slot machine was also a poker machine, a keno machine, you name it. The slot machine was turned into a virtual multidimensional gaming device.

By linking two consecutive games into one game the bonus games added yet another equation to the problem. Now the slot machines are linked both in space and time.

The Indian gaming expanded the social dimension to the slot machines on a national scale. Now not just Nevada but the whole nation uses the slot machine as tool to aggregate disposable income and allocates it to solve community issues.

II. SUMMARY OF THE INVENTION

The novelty of the approach in this new game design is, that in contrast to the traditional casino slot games the player is offered a series of betting rounds in a slot game based on the computer evaluation or processing of precompiled data in real time to the dynamically changing real probabilities of the game outcomes and associating awards to them. Also considering some established paradigms in the gaming industry, at any time during the game the player can engage into the betting round, skip and proceed to the next betting round, or be able to exit the game without any penalty.

The 21st century marked an explosion in technological innovation and information. This created a challenging environment for every one of us in making decisions every day of our lives in imperfect information. As information changes throughout the course of an execution, we have to reevaluate our initial decision and take appropriate actions to improve our performance.

For the purposes of this invention a casino game is defined as a finite set of possible outcomes, a method for independently choosing a subset from this set as game outcomes, and a pay table that allows the translation of the game bets based on the game outcomes into game win. Considering any specific casino game we determine that we start a new game when from the same finite set of sequences we use the same method to chose a different subset of outcomes which is independent from the outcomes of the previous game and uses the same pay table for the win, although the bet may be different.

Therefore comparing 2 casino games we say that they are different if: (a) they differ in their finite set; and/or (b) they differ in their outcome subset; and/or (c) they differ in their pay table.

The current invention is aimed to provide a method for designing casino slot game that will match our environment. The current innovative game design links together more than one game through their bets and their outcomes. If we arrange the bets of more than 2 games in the rows of a table and the outcomes in the columns of the table, we will obtain a multidimensional matrix as far as the games have some common bets and some common outcomes (In this invention we are not going to discuss the subclass of diagonal matrixes as they don't present any interest to us). Next with a computer we calculate the probabilities of all bets and outcomes in the table in real time. By real time we mean that the computer is either dynamically solving the so formed matrix with methods of the mathematical optimization, or simply retrieving the data from previously created and statically stored tables. In both case we can derive and use parameterized approximation functions in well-behaved subsections of the matrix, either to speed up the calculations, or reduce the size of the tables, hence increase the speed also. As the player is receiving additional information in the course of the game, he has to make decision in each betting round based on future events that will be revealed later in the game, which is defined as insufficient information.

For better illustration of the idea we will use a basic example. A player tosses a dollar coin in a casino. If he gets tails, he loses his dollar, if he gets heads, the casino pays him \$0.95. Let's now try to improve the game. The player can toss two \$1 coins. If both are tails, he loses them, if 1 is heads, he gets \$0.95, if both are heads, he gets \$1.90. We can describe the so designed game in the following table:

| | 0 | 0.95 | 0.95 | 1.9 |
|---|---|---|---|---|
| 1st coin | T (0.25) | H (0.25) | T (0.25) | H (0.25) |
| 2nd coin | T (0.25) | T (0.25) | H (0.25) | H (0.25) |

Legend: T = tails
H = heads

And the probabilities will look like:

| Probabilities | Pays | Percent |
|---|---|---|
| 0.5 × 0.5 = 0.25 | 0 | 0.00% |
| 0.5 × 0.5 = 0.25 | 0.95 | 23.75% |
| 0.5 × 0.5 = 0.25 | 0.95 | 23.75% |
| 0.5 × 0.5 = 0.25 | 1.9 | 47.50% |
| | | 95.00% |

With a little effort this game can be promoted to making decision in insufficient information for the player. The player tosses a $1 coin. If it is tails, he may toss a second $1 coin and win $0.96 or lose all. If he gets heads on the first, he can take $0.95 or toss a second coin and either win $1.92 or lose a $1.

As the entertainment value of tossing the first coin is equal to the entertainment value of tossing a second coin, we had to pay the player a penny to lure him to toss the second coin instead of starting a new game. But in more complex games this is not necessary. Just the opposite, we can as well charge the player a penny or more if the entertainment value of "tossing a second coin" is greater than that of "tossing a first coin". Also in more complex games the probabilities will not be that obvious, so we will need to use more sophisticated mathematical algorithms and computers.

FIG. 1 gives the general idea of a casino game in which the player makes a decision based on insufficient information. The player starts the game at step 25 placing a bet for the first betting round (step 27). The computer displays the bet and the possible game awards for the current betting round at step 29. The player evaluates the information at step 39. He decides if he wants to raise his bet at step 41. If not, he has to decide if he will play more betting rounds at 43. If not he ends the game at this betting round and the computer pays any unpaid winnings accumulated at 47 and the game ends at step 49.

If the player chooses to play more betting rounds either by raising the bet at 41 or staying with his bet at step 43, the computer may pay or may not pay the win from the betting round at step 45. This is determined by the game designer, who will chose if the computer will pay the bet round win immediately after the completion of the betting round at step 45*a*, or the computer will accumulate the win from the bet rounds in a separate win meter at step 45*b*. The computer may also allocate the total bet (the bet accumulated in the previous betting rounds plus the bet raise for the current betting round) in respect to the probabilities of the current bet round outcomes. In each particular case this will be dictated by the entertainment value of the underlying game and its perception by the game designer but will not affect the general logic flow in the game design.

At step 31 and 35 the computer either dynamically or statically, or as a combination of both methods, evaluates the probabilities and allocates awards for the outcomes in the next betting round (in step 33 or 37 alternatively). Then the total bet and the contract for the next betting round are displayed again at step 29. This circular routine may last either until the player decides to end the game, or until a certain resource that regulates its recurrence has been reached. This may be based on a decision that the casino may not want further increases in the payout percentage due to generating excessive losses to the casino, or substantially increasing the game volatility, or a diminishing entertainment value, or encouraging compulsive gaming behavior, etc. The utilization of multiple input/output quantitative models of the game allows any set of different specification requirements to be explicitly defined as a limiting resource in the optimization model. Upon exhausting this resource the optimization algorithm will force the computer to exit the recurring game loop.

The first computational algorithm for the above model, the simplex method, was created by George Dantzig in 1947. Many other algorithms were developed later on with different success on speed and accuracy, but for the first time the linear programming became feasible for practical problems only in the late 80's, with the invention of the PC computers and the development of many optimization software packages like LINDA, GAMS, LP_solve etc.

The third major element in the game design is the physical limitation in human beings. There is an absolute time limit for us to push buttons, absorb information, react to a change and make a decision. Today's technological advances in computer hardware have made it possible for Electronic Gaming Machines ("EGM") to calculate the probabilities for multiple players choices and game outcomes faster than human limitations and the traditional duration of slot games. Using the advances in decision theory to design complex scenarios, in mathematical programming to solve them and in computer hardware and software to implement them, EGM manufacturer can design more entertaining games for the players.

The distinguished features of the present invention are described as (a) Entertainment value—players will have more choices and make decision in insufficient information.

(b) Monetary value—the player's bets and game awards in the slot game can be measured in multiple dimensions and may span over multiple consecutive games.

(c) Business value—the profit margin for the casino operator can be reliably secured by computers and mathematical algorithms.

(d) Fiscal value—the business taxes on the casino operators can be reliable assessed in complex slot games by computers and mathematical algorithms.

In summary, the difference of the current invention in regard to any previous slot games is that the new game design links multiple consecutive casino games in a single game through their bets and outcomes in real time. The significance of the real time is that the player can interactively build the slot game story.

We can link any kind of games, like the homogeneous games True Odds Texas Hold'Em and True Odds Razor Poker that are discussed in more detail later on, or keno and bingo. They can very well be heterogeneous if we link poker with slot and keno. The only necessary condition is that a subset of their bets and outcomes overlay. Otherwise the matrix will become diagonal and we will find ourselves playing the well known multigame EGM.

for the last stage of the game. In the second variation we will have different probabilities and subsequently different pay tables for the different colors.

We can visually represent the linking of the subsets of the outcomes and bets of this game, representing the different colors and their pay tables and bets in the following pay table:

TABLE 1

| Pay table 3 | | | | | | | | |
|---|---|---|---|---|---|---|---|---|
| | | Pay table 2 | | | | | | |
| | | | | Pay table 1 | | | | |
| Brown | Red | Yellow | Turquoise | Purple | Blue | Green | Blue | |
| | | | | Win | Win | Lose | Lose | Tetrahedron |
| | | Win | Win | Win | Win | Lose | Lose | Cube |
| Win | Win | Lose | Lose | Win | Win | Lose | Lose | Octahedron |

The new game design is not a mere bet change in the series of bet rounds, like the double up in poker games, the split and the insurance in Black Jack, the rescind of the initial bet in Let it Ride, the buying of reels or features in slot games, the additional bet to draw a sixth card in Second Chance Poker, etc. It is an interaction between the bets and the game outcomes in a sequence of game states. It is interaction in real time, which implies the player chooses among the bets and the outcomes in imperfect information. This also implies that at any time the player upon his sole discretion can make a bet, skip a bet or end the game without any penalty.

As stated above, this new approach for designing casino games links together multiple casino games in a single casino game to offer to the player more than one pay table to choose from as part of the game. To achieve this we need two or more games that either differ in their finite set of all game outcomes, or in the subset of the chosen outcomes, or the methods they utilize to choose the game results are not independent.

For better illustration of the idea we will use a simple example. Assume we have three games, in which we roll a tetrahedron, an octahedron and a dice. The tetrahedron game has four outcomes, the cube has six outcomes and the octahedron has eight outcomes. For simplicity we assume that it is a fair game, i.e. there is no pay to the casino and 100% of the bets are paid back to the game players based on the probabilities of occurrence.

We can start with the first game and after the player places his bet and rolls a tetrahedron, then in a second stage of the combined game we can offer the player the second pay table and replace the tetrahedron with a cube, then in a third stage of the combined game reveal to him two additional outcomes and an opportunity to roll an octahedron. Or alternatively, we can select an octahedron and paint any two sides with the same color for the first stage of the game, then change the two different colors with two new colors for the second stage and finally change the final duplicate colors with remaining colors A real tetrahedron, octahedron and a cube all faucets have equal chances, and the probabilities for each side are the same when rolled, therefore there will be not any variation in the awards or the different outcomes and not much excitement for many players. However, in an example of another very popular casino game, the Video Draw Poker, a typical 9-6 Jacks Or Better game has the following probabilities and pay amounts:

TABLE 2 [1]

| Hand | Payoff | Combinations | Probability | Return |
|---|---|---|---|---|
| Royal flush | 800 | 500,790,444 | 0.000025 | 0.020099 |
| Straight flush | 90 | 2,378,594,904 | 0.000119 | 0.010740 |
| 4 of a kind | 25 | 47,057,767,584 | 0.002361 | 0.059019 |
| Full house | 9 | 229,325,520,096 | 0.011505 | 0.103542 |
| Flush | 6 | 223,054,389,492 | 0.011190 | 0.067140 |
| Straight | 4 | 220,034,964,156 | 0.011039 | 0.044154 |
| 3 of a kind | 3 | 1,482,730,554,984 | 0.074385 | 0.223155 |
| Two pair | 2 | 2,575,465,030,008 | 0.129205 | 0.258409 |
| Jacks or better | 1 | 4,259,815,156,080 | 0.213704 | 0.213704 |
| Nothing | 0 | 10,892,867,749,452 | 0.546468 | 0.000000 |
| Total | | 19,933,230,517,200 | 1.000000 | 0.999962 |

[1] http://wizardofodds.com/games/video-poker/tables/jacks-or-better/

If we create three different games using these statistics, the first one will pay only the first four hands, i.e. the Royal Flush, the Straight Flush, the Four of a Kind and the Full House, the second one will pay for the Royal Flush, the Straight Flush, the Four of a Kind, the Full House, the Flush and the Straight and the last one will pay for all listed unique hands, i.e. for the Royal Flush, the Straight Flush, the Four of a Kind, the Full House, the Flush, the Straight, the Three of a Kind, the Two Pair and the Jacks or Better.

TABLE 3

| Pay table 3 | | | | | | | | | | |
|---|---|---|---|---|---|---|---|---|---|---|
| | | | | Pay table 2 | | | | | | |
| | | | | | | Pay table 1 | | | | |
| All other hands | Jacks or Better | Two Pair | Three of a Kind | Straight | Flush | Full House | Four of a Kind | Straight Flush | Royal Flush | Player Return[2] |
| | | | | | | 50 | 100 | 500 | 5000 | |
| 0 | 0 | 0 | 0 | 0 | 0 | 0.5753 | 0.2361 | 0.0595 | 0.1250 | 99.585% |
| | | | | 15 | 20 | 30 | 75 | 300 | 2000 | |
| 0 | 0 | 0 | 0 | 0.1656 | 0.2238 | 0.3452 | 0.1771 | 0.0357 | 0.0500 | 99.731% |
| | 1 | 2 | 3 | 4 | 6 | 9 | 25 | 90 | 800 | |
| 0 | 0.2137 | 0.2584 | 0.2232 | 0.0442 | 0.0671 | 0.1035 | 0.0590 | 0.0107 | 0.0200 | 99.985% |

[2]For illustrative purposes we are assuming that the change in the pay awards will not influence the hold strategy for the player, and therefore the probabilities in the different games. The affected probability of the change in the pay tables can easily be offset by using computer simulation models and fast algorithms.

For illustrative purposes we are assuming that the change in the pay awards will not influence the hold strategy for the player, and therefore the probabilities in the different games. While we are using the described approach to create more practical games, the probabilities will not be that obvious, so we will have to employ more sophisticated mathematical techniques and algorithms in computers to determine the odds that reflect more realistic probabilities.

As we place the total outcomes of the linked games in the table rows and the game pay tables in columns, we will notice that some of games outcomes and some of the pay table categories are the same. We can as well combine, or overlap these rows and columns and consolidate the total number of outcomes game results in the new game. If we refer to the bets in the rows as inputs and to the outcomes in the columns as outputs then we end up with an Input/Output table. If the determination of the outcomes of the linked games maintains their independencies in the combined game, we can express the so designed table mathematically in the following system of simultaneous linear equations:

$$\sum_{j=1}^{n} c_j x_j \text{ -> } \max$$

Subject to:

$$x_j \geq 0,\ j = 1, 2, \ldots, n.$$

$$\sum_{j=1}^{n} a_{ij} x_j \leq b_i,\ i = 1, 2, \ldots, m.$$

Where

- j stands for the pay categories to be rewarded depending on the played game, i.e. poker, slot, keno, black jack etc.
- i represents the players options to chose between the different pay tables, that is different betting options in every round, different gambling strategies in poker, different cards in keno and bingo, etc.;
- $c_j$ represents the constant total number of outcomes in the different pay table of the game, normally these are constant values, but they as well could be the limit of any converging infinite mathematical function;
- $x_j$ represents the prizes for each outcome in the multiple pay tables to be determined;
- $a_{ij}$ is the matrix of probabilities for each player choice j and each possible game outcome;
- $b_i$ are genuine restrictions on the players choices, for example one easily identifiable i is the players disposable income (or the bankroll as they like to call it), another one is the casino margin (obviously if the game is not profitable for the casino it will take it off the floor), in poker we can easily identify the next 32 constraints with all possible combination for 5 cards, etc.

If the methods for choosing the gaming results in the linked games are dependent, then we will need to use more complex non-linear equation to express the relations between the total outcomes and the pay tables in the newly created game. In either case we can use well defined mathematical methods and Input/Output Analyses techniques to solve the so defined problem.

In addition we may extend the approach in the game design and add or eliminate outcomes and results to the pay tables by adding or removing rows and columns either to simplify or make the game more exciting. In either case we are adding or removing equations and parameters to the previously well define and solvable problem of mathematical optimization to design a game in which the player is offered a multitude of pay tables to choose from.

Further in the game design of the linked game we may introduced distinct states, during which we may reveal to the player partial information in the process of selecting a pay table from the multitude of the pay tables offered in the linked game. In such instances we are transforming the new game into a problem of making a decision in insufficient information. Such problems is defined as the Expected Value of Perfect Information (EVPI) in the decision theory as set forth in Douglas Hubbard "How to Measure Anything: Finding the Value of Intangibles in Business" pg. 46, John Wiley & Sons, 2007. The problem is modeled with a payoff matrix $R_{ij}$ in which the row index i describes a choice that must be made by the player, while the column index j describes the random game outcomes of each round the player does not yet have knowledge of, determined by the probability $p_j$ of winning j. If the player is to choose i without knowing the value of j, his best choice is the one that maximizes the Expected Monetary Value (EMV):

$$EMV = \max_i \sum_j p_j R_{ij}.$$

Here $$\sum_j p_j R_{ij}.$$

is the expected payoff for action i, and $$EMV = \max_i$$

denotes choosing the maximum of these expectations for all available actions. With perfect knowledge of j, the player may choose a value of i that optimizes the expectation for that specific j. Therefore, given perfect information, the expected value is given in $$EV|PI = \sum_j p_j\left(\max_i R_{ij}\right),$$

where $p_j$ is the probability that the system is in state j, and $R_{ij}$ is the pay-off if one follows action i while the system is in state j. Here $$\left(\max_i R_{ij}\right),$$

indicates the best choice of action i for each state j.

The expected value of perfect information is the difference between these two quantities, $$EVPI=EV|PI-EMV.$$

This difference describes, in expectation, how much larger a value the player can hope to obtain by knowing j and picking the best i for that j, as compared to picking a value of i before j is known. Note that EV|PI is necessarily greater than or equal to EMV. That is, EVPI is always non-negative.

After designing a new game by employing the described new innovative method, all we have to do is clearly define and manifest to the player the techniques he can use to select the pay table he wants to gamble on from the multitude of pay table offered by the game. This method will vary from game to game depending on the nature of the game, as described herein, as they strongly depend on the specifics of the game. But in general their definition is inseparable from offering multiple pay tables to the player to choose from. Although it can be summarized in this section that in common they must be entertaining and easy to present to the player, so he can intuitively select the pay table on which he wants to bet.

III. DESCRIPTION OF THE DRAWINGS

IV DESCRIPTION OF THE PREFERRED EMBODIMENT

The exemplary embodiment of the current invention is presented by two prominent representative games in the casino slot industry, epitomizing two very distinctive classes of the casino games: skilled and non-skilled games of chance.

The first exemplary case according to this invention details the implementation in non-skilled slot games. Texas Hold'Em surged in popularity worldwide thanks to the popularity of online poker, the promotion on television through the World Series of Poker championship and the release of major movie blockbusters by Hollywood sporting the game. But yet it had not found its match on the casino floors as an EGM. The game herein and after described is called True Odds Texas Hold'Em (TOTH'Em). It is designed to be played on a computerized slot gaming device by a single player.

One standard fifty-two card deck is used with the traditionally established poker rankings. Clearly displayed contracts (payoff schedules) are presented to the player before he places his wager. After two cards are revealed to the player, his is offered another contract with better or equal odds to wager on. The player may raise his bet, proceed to the next betting round or finish the game without raising the wager and qualifying for the awards from the contract he had bet on. Three more cards are displayed and another contract with improved odds and optional round of betting are displayed. Again, the player may raise his bet, skip to the next betting round with the placed wager and corresponding contract or simply finish the game (the showdown option). The "Turn card" is displayed and the last round of betting is offered to the play. He may raise or keep his bet with the respective contract being enforced and finish the game by displaying the last ("The River") card.

Figure 1:
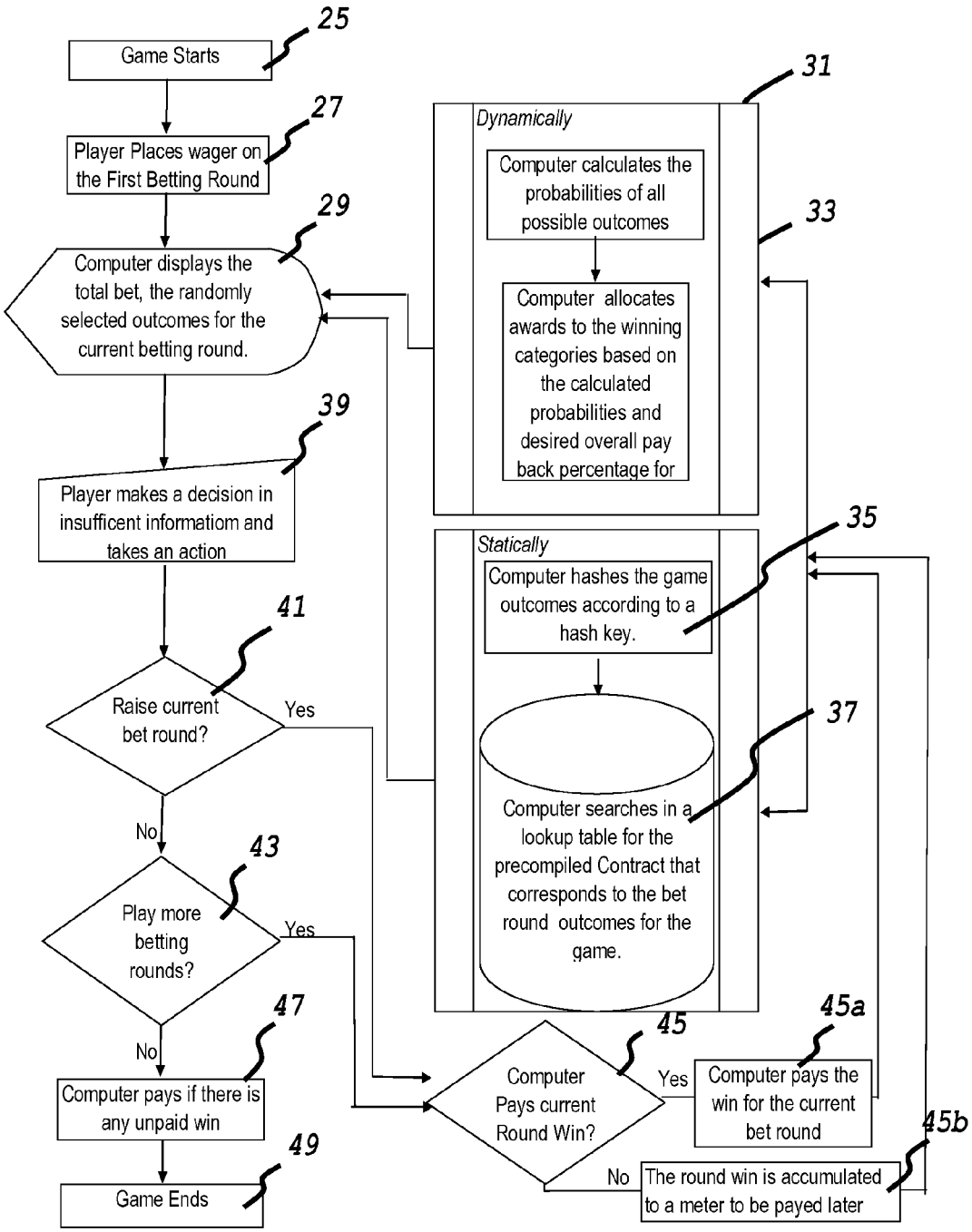
FIG. 1 is a flow chart of the new wagering casino slot game system.
Figure 2:
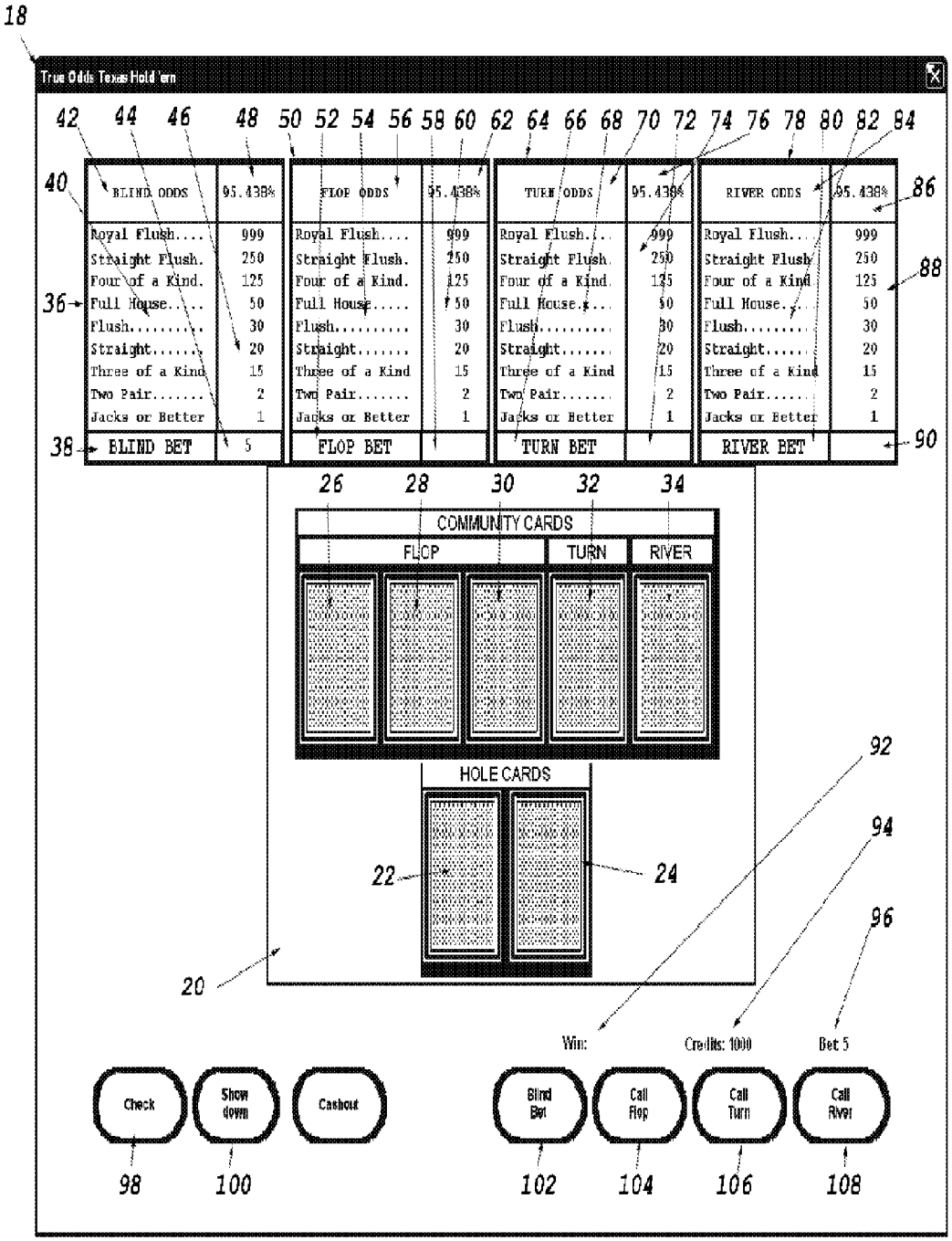
FIG. 2 is a display of the video screen after the player places his or her wager to initiate the True Odds Texas Hold'Em game.
Figure 3:
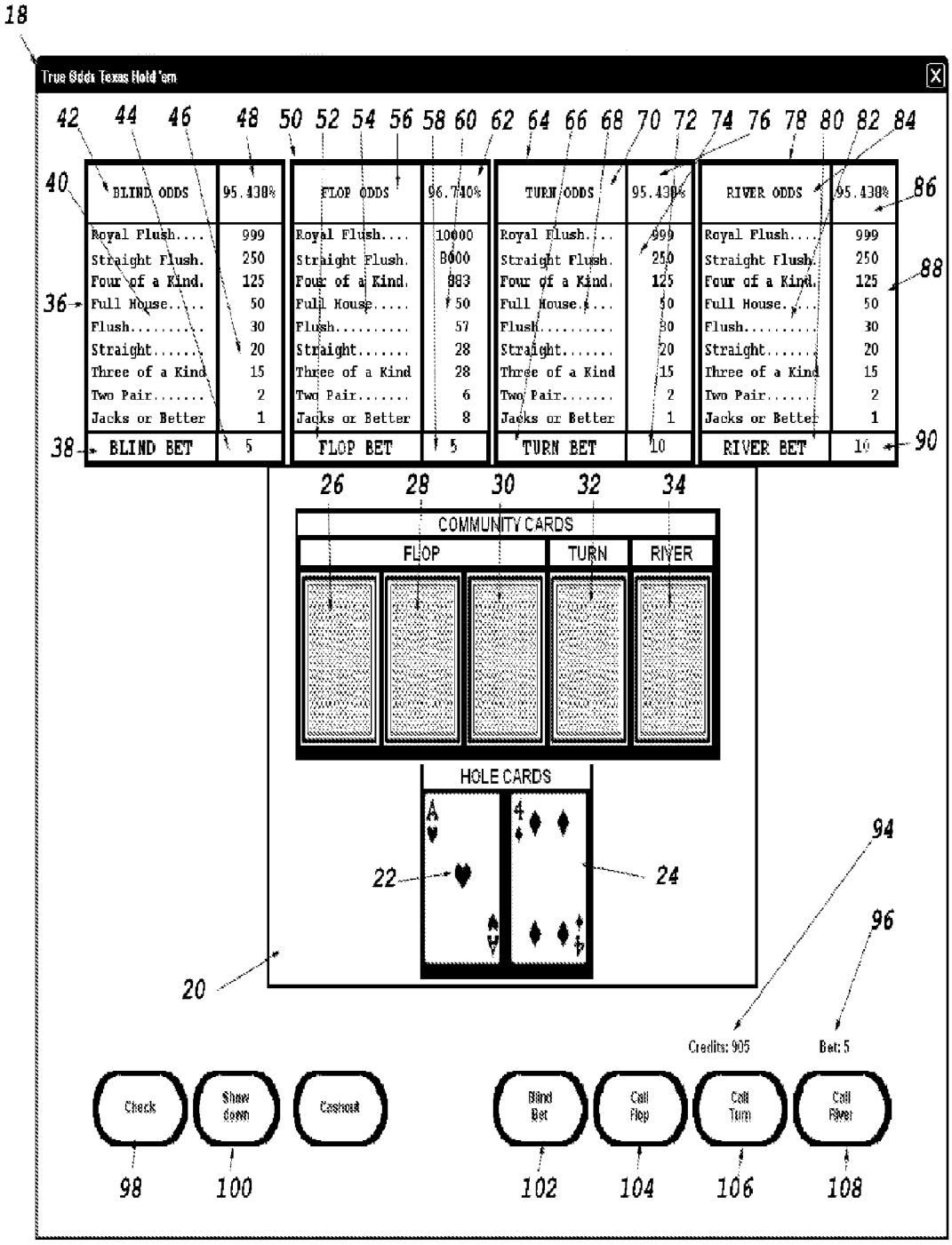
FIG. 3 is a display of the video screen after the Hole cards are dealt and displayed face up.

For better illustration of a player playing the game, reference will be made to the screen displays in combination with the flow chart illustrated in FIG. 7. A video screen 18 initially appears to the player as seen in FIG. 2. The game clears and begins at step 55. At step 57 the player places his wager on a poker hand 20. It is assumed, that the player wagers the required 5 credits called a blind bet in area 38 and displayed in area 44 for a first contract 36 to take effect. The first contract 36 is comprised of area 40 displaying the winning hands, an area 46 displaying the prizes for the winning hands, a window 42 displaying "Blind Odds" and a window 48 displaying the real odds or pay back percentage. A bet meter 96 displays the amount of the player's wager. Seven cards, 22, 24, 26, 28, 30, 32 and 34 representing a typical Texas Hold'Em Hand 20 are dealt to the player face down. At this point as there are no cards revealed and therefore there is no information on the cards value, all contracts 36, 50, 64 and 78 look exactly the same. At step 59 the game computer (not illustrated) deals the hole cards 22 and 24 face up from a randomly shuffled standard deck of cards as illustrated in FIG. 3

At step 61 the computer evaluates the probabilities of winning any of the awarded categories for the remaining 50 cards in the deck. Then it optimizes the initial bet and the required raise among all the possible prizes. It applies the general rule of the gaming industry that only the highest win pays and aims at a predetermined targeted return to the player, which is higher than the one in the first contract 36. In the optimization process the computer may employ additional criteria to generate prizes which will be attractive to the player. The second contract 50 is comprised of area 54 displaying the winning hands, an area 60 displaying the prizes for the winning hands, a window 52 displaying "Flop Bet", a window 56 displaying "Flop Odds", and a window 62 displaying the real odds or pay back percentage. The required raise of the bet is displayed in area 58. The player can depress a "Call Flop" button 104 to raise his bet and qualify for contract 50, depress a "Check" button 98 to reveal the flop cards 26-30 without raising the bet and accepting the contract 50, or simply depress a "Showdown" button 100 and reveal all cards 26-34. In the last case the amount won, if any according to the first contract 36, is displayed on a win meter 92 (shown in FIG. 6) and added to a credit meter 94.

Figure 4:
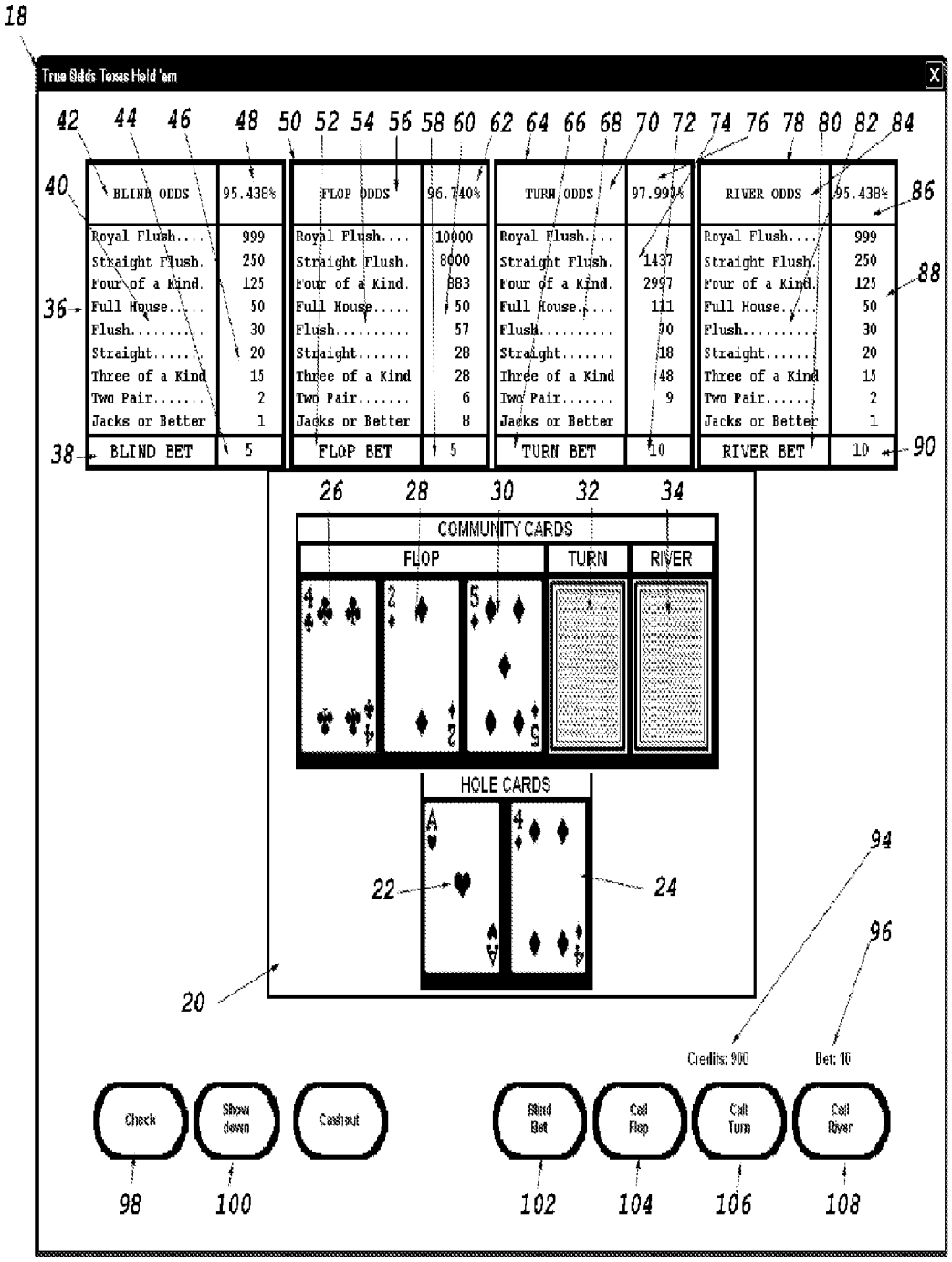
FIG. 4 is a display of the video screen after the Flop cards are displayed face up.
Figure 6:
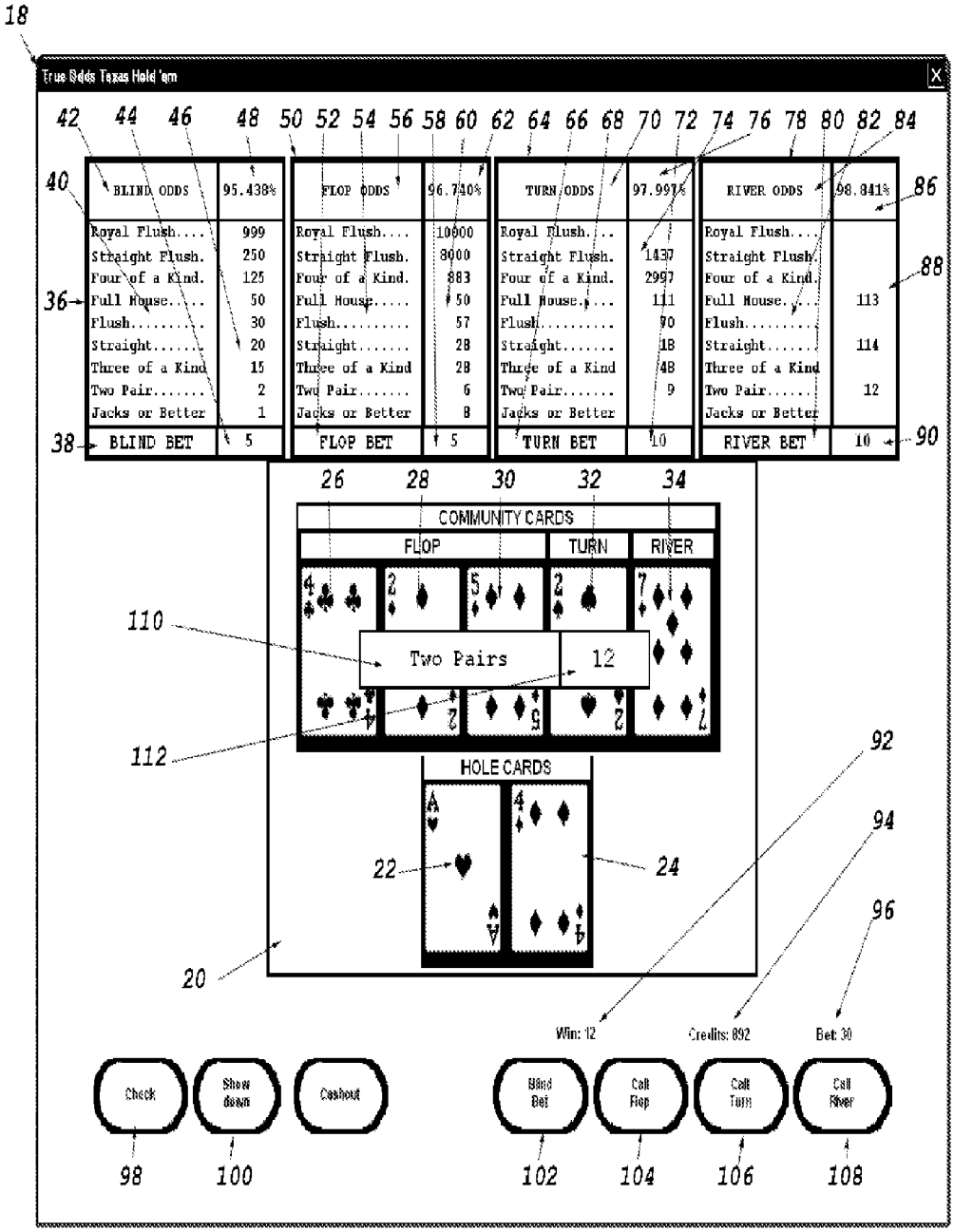
FIG. 6 is a display of the video screen after the River card is displayed face up.
Figure 7:
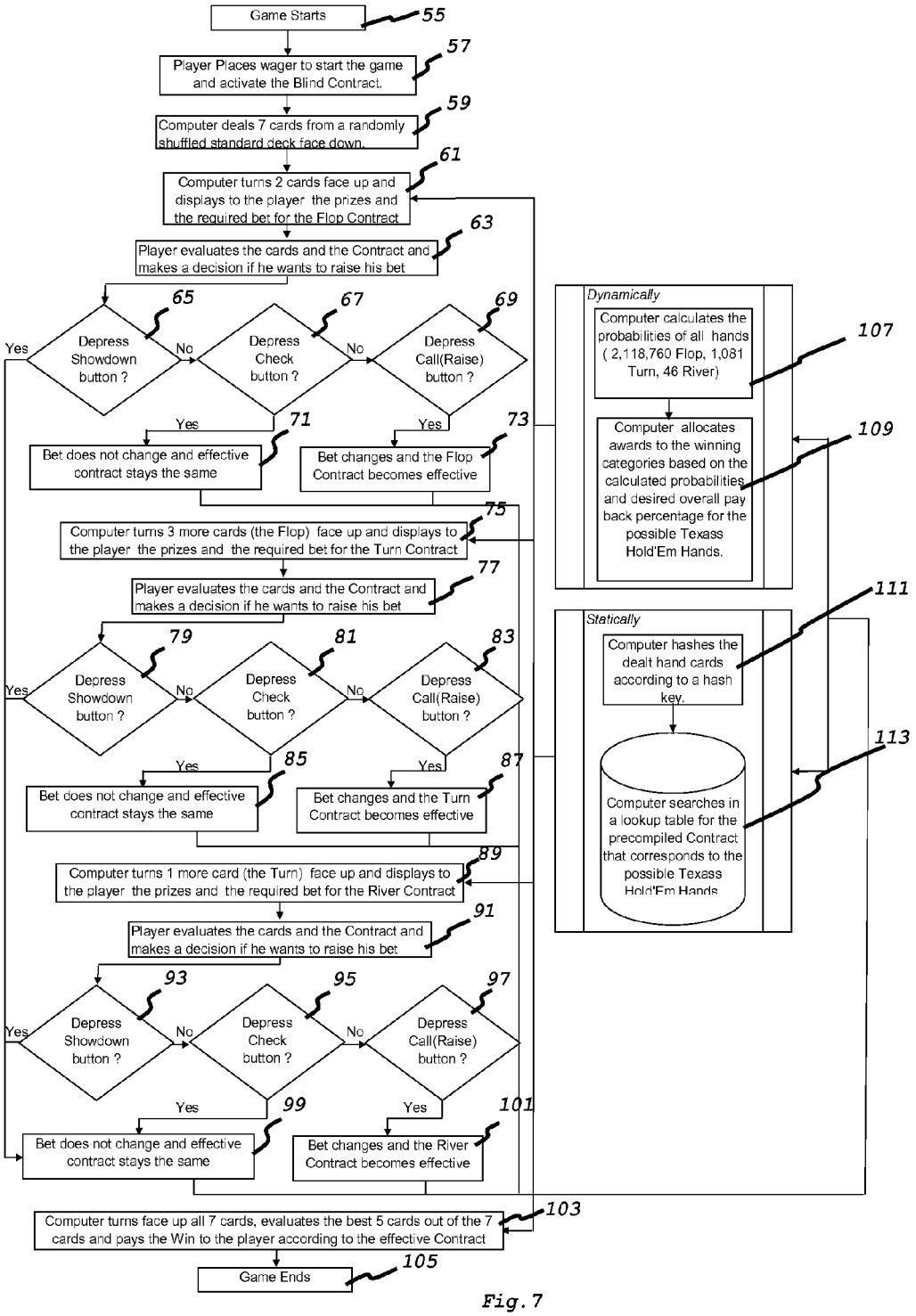
FIG. 7 is a detailed flow chart of the True Odds Texas Hold'Em game.

As seen in FIG. 4 and as described in FIG. 7, at step 75, as soon as the first round of betting is completed, the computer displays the flop cards 26-30 and evaluates the odds for the next betting round. It evaluates the probabilities of winning any of the awarded categories for the remaining 47 cards in the deck. Then it optimizes the current bet of the player and the required raise for the player to qualify for the next contract 64. All possible prizes are allocated based on the general rule in the gaming industry that only the highest win pays, and a predetermined targeted return for this betting round. This targeted return percentage is chosen to be higher than the return of the active contract to attract the player's participation in the betting process. In the optimization process the computer may employ additional criteria to generate enticing prizes to the player. The third contract 64 is comprised of area 68 displaying the winning hands, an area 74 displaying the prizes for the winning hands, a window 66 displaying "Turn Bet", a window 70 displaying "Turn Odds", and a window 76 displaying the real odds or pay back percentage. The required raise of the bet for contract 64 is displayed in area 72. The player can depress a "Call Turn" button 106 to raise his bet and qualify for contract 64, depress the "Check" button 98 to reveal the turn card 32 without raising the bet and declining contract 64 or simply depress the "Showdown" button 100 and reveal all remaining cards 32-34. The amount won, if any, according to the contract that the player qualified for, is displayed on the win meter 92 (shown in FIG. 6) and added to the credit meter 94.

Figure 5:
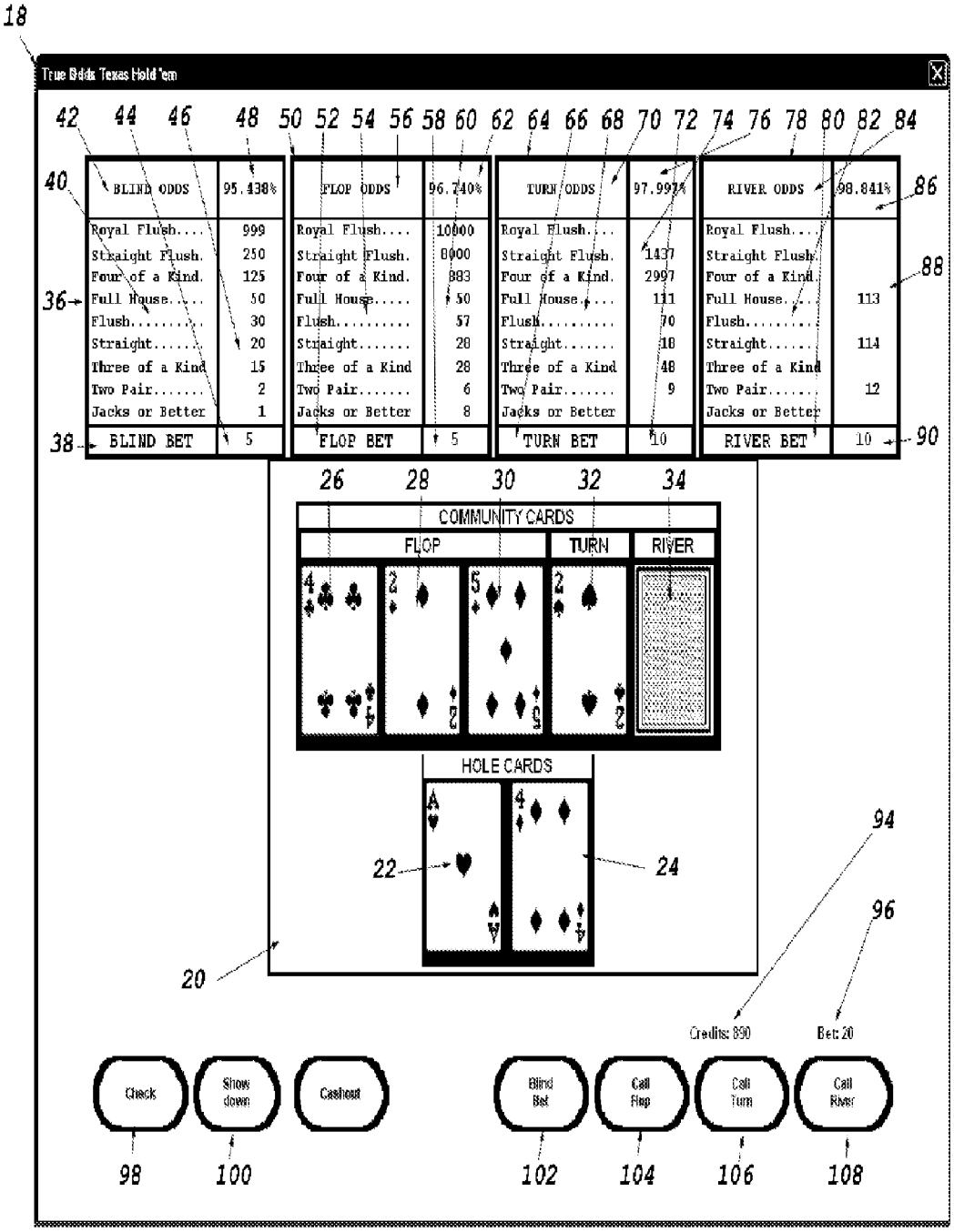
FIG. 5 is a display of the video screen after the Turn card is displayed face up.

On the next betting round as seen in FIG. 5 and as described in FIG. 7 at step 89, as soon as the second round of betting is completed, the computer displays the turn card 32 face up and evaluates the odds for the next betting round. It evaluates the probabilities of all possible winning categories for the remaining 46 cards in the deck. Then it optimizes the current bet of the player and the required raise for the player to qualify for the next contract 78. All possible prizes are allocated based on the general rule of the gaming industry that only the highest win pays and a predetermined targeted return for this betting round. This targeted return percentage is again set to be higher than the return of the active contract to further involve the player into participating in the betting process. In the optimization process the computer may employ additional criteria to generate attractive prizes to the player. The forth contract 78 is comprised of area 82 displaying the winning hands, an area 88 displaying the prizes for the winning hands, a window 80 displaying "River Bet", a window 84 displaying "River Odds", and a window 86 displaying the real odds or pay back percentage. The required raise of the bet for contract 78 is displayed in area 90. The player can depress a "Call River" button 108 to raise his bet and qualify for contract 78, depress either the "Check" button 98 or the "Showdown" button 100, which in this case is equivalent, to reveal the river card 34 without raising the bet and declining contract 78.

FIG. 6 displays the end of the game. All cards 22-34 are displayed face up. Assuming that the player has participated in all betting rounds he has "Two pairs" and has won 12 credits as displayed in area 88 according to contract 78. His prize is also displayed on the win meter 92 and added to the credit meter 94. Had the player skipped the raise for the last betting round by either depressing the "Check" button 98 or the "Showdown" button 100, the bet meter 96 would have shown 20 credits and the win meter 92 would've shown 9 credits according to contract 64.

If the player had hit the "Showdown" button 100 in the second betting round his win would be displayed as 6 credits in win meter 92 according to contract 50, but the bet meter 96 would also show only 10 credits.

Finally if the player had hit the "Showdown" button 100 in the first betting round his win would be displayed as only 2 credits in win meter 92 according to contract 36, but the bet meter 96 would also show only 5 credits.

In the described embodiment of the invention only one pocket was dealt to the player. This has been chosen for practical reasons: due to the novelty of the game the simplicity improves the clarity. But obviously there are no limits to offer more pockets to the player. It is strongly emphasized that in the general case neither the number of pockets dealt to the player, nor the offered betting schemes need to be always the same in different implementation of the game. It could very well be played with different poker categories in the contracts. The overall framework is flexible enough also to utilize different kind of decks including one or more jokers and/or different wild cards like in other currently played video poker games in the casinos.

Yet in other embodiments of TOTH'Em the player may be offered to keep any number of the initial pockets concealed and reveal them at any round with different betting schemes.

In this case the entertainment aspect will be expanded by providing the player with the opportunity of evaluating different subsets of poker hands and applying different betting strategies. Such embodiments will be possible only in gaming jurisdictions which allow games of skills, but they are subject and will be discussed in more depth in the next preferred embodiment.

Figure 8:
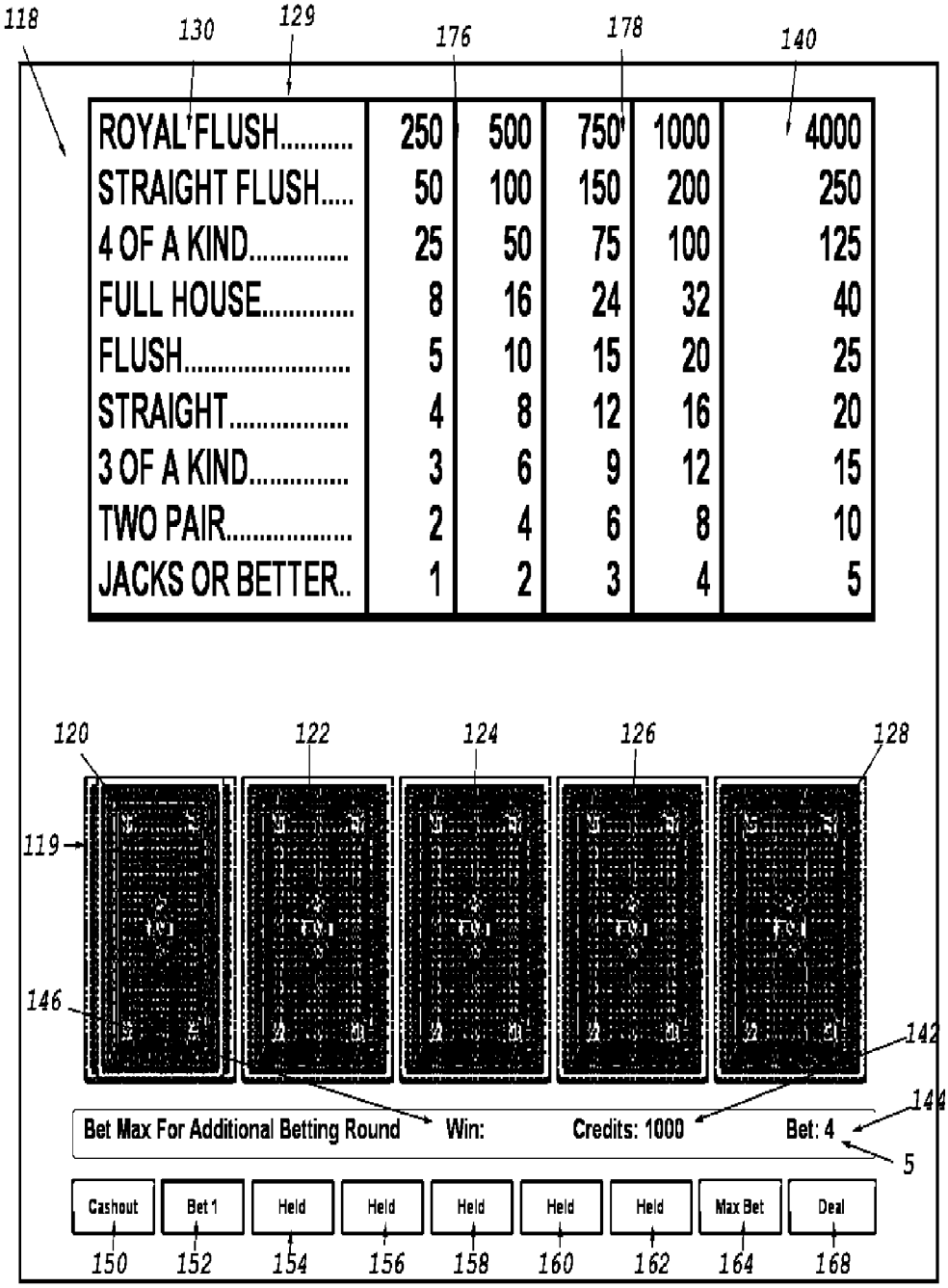
FIG. 8 is a display of the video screen after player places his or her wager to initiate the True Odds Razor Poker game.

Turning to FIG. 8, there is illustrated the second preferred embodiment of the current invention applied to skilled games. By skilled game it is implied that the ability of the player influences the final results of the game by his actions. The exemplary game hereinafter described is called True Odds Razor (TOR). The resemblance to its next to kin, the video draw poker is unmistaken.

Video monitor 118 displays a typical Video Draw Poker Hand 119 that is comprised of five cards 120, 122, 124, 126 and 128. Initially only the backs of the cards 120-128 are displayed. A genuine Jacks or Better contract 129 (Pay Table) is displayed above the Poker Hand 119. A first column 130 in contract 129 displays the names of the winning categories of the contract 129. A second column 132 displays the awards for 1 credit bet by the player, and columns three through six, 134-140, display respectively the awards for 2, 3, 4 and 5 credits bet by the player. Generally the cards are dealt from "standard" fifty-two card decks which may also include jokers.

There is also displayed an area 148 which provides genuine instruction to the player during the course of the game to facilitate his actions, an area 146 to display the players win, an area 142 to show his credits and an area 144 to display the wager. All the available controls to the player 150-168 are displayed below. Control 150 allows the player to cash out his credits. Control 152 allows the player to bet one credit. Controls 154-162 allow the player to hold or discard respectively cards 120-128. Control 164 allows the player to bet the maximum allowable wager. Control 168 instructs the game to deal the cards.

Figure 9:
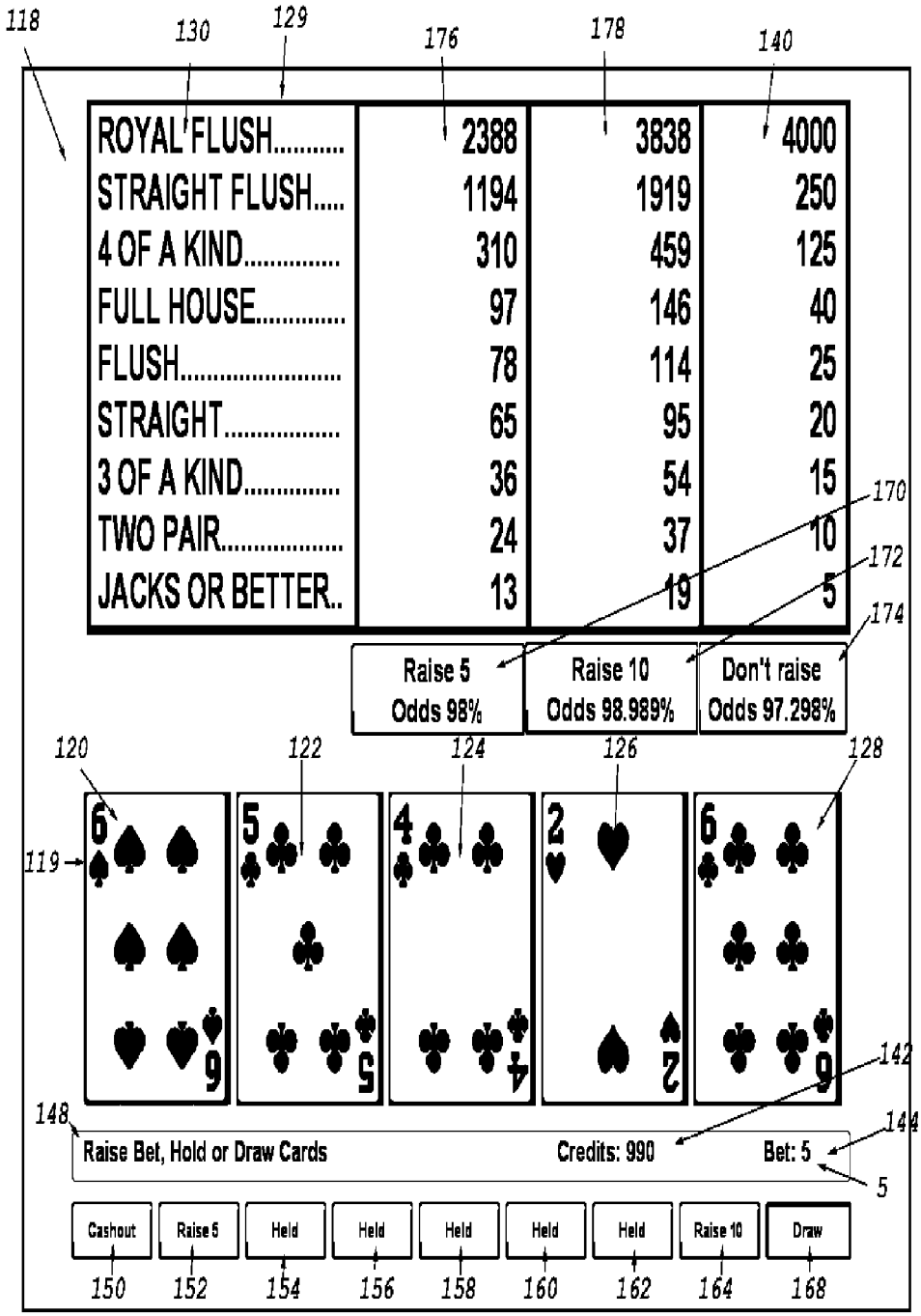
FIG. 9 is a display of the video screen after 5 randomly selected cards are turned faced up and the computer has evaluated and displayed the contracts for the bet raise.

For better illustration of game flow a reference will be made to the screen displays in combination with the flow chart illustrated in FIG. 13. The video screen 118 initially appears to the player after he places his wager as seen in FIG. 8. The game starts at step 155 in FIG. 13. At step 157 the player places his wager on the poker hand 119. It is assumed, that the player wagers 5 credits which is displayed in area 144 of FIG. 8. At step 159 the game computer (not illustrated) deals the five cards 120-128 face up from a randomly shuffled standard deck of cards as illustrated in FIG. 9.

Figure 13:
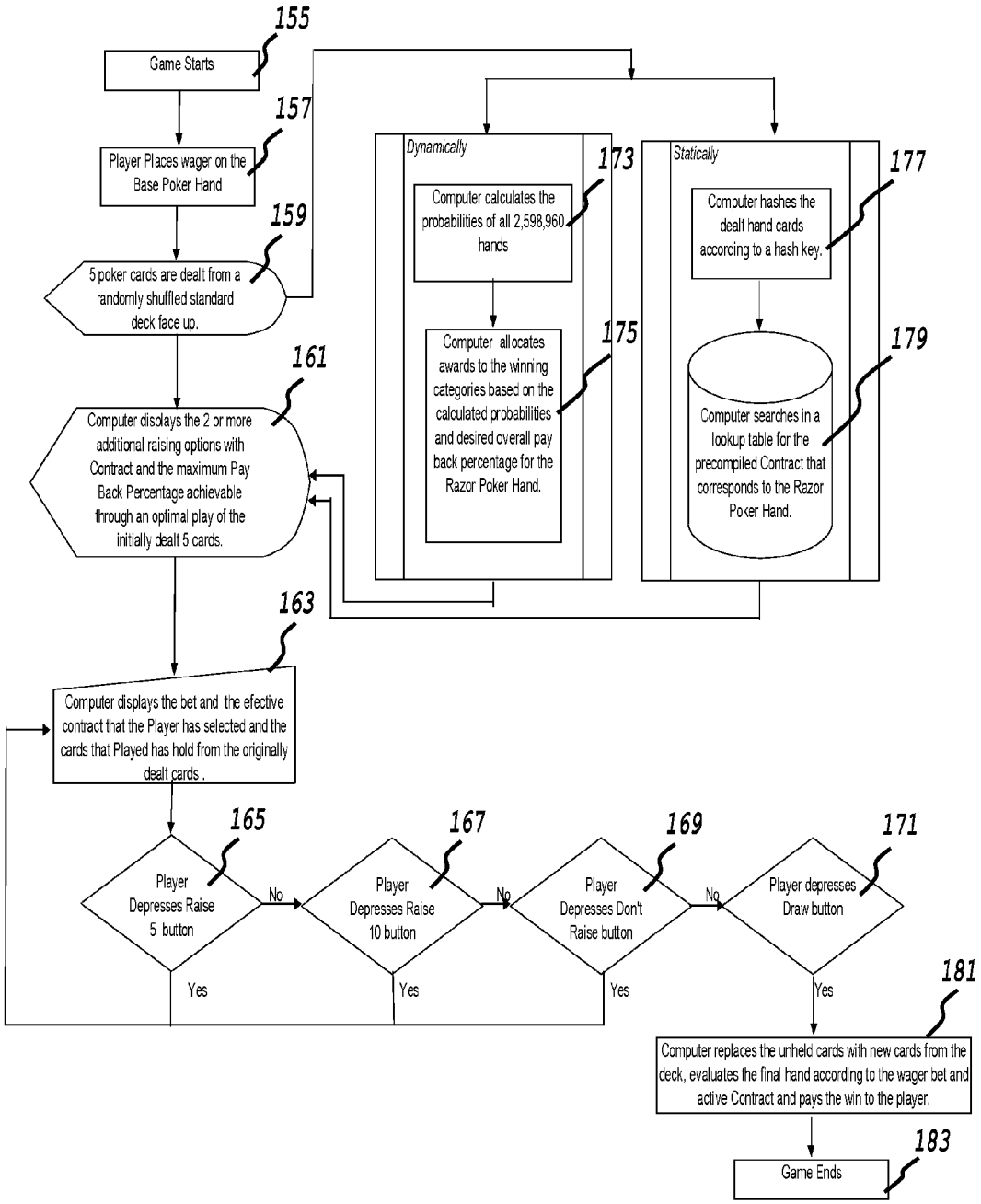
FIG. 13 is a detailed flow chart of the True Odds Razor Poker game.

As described in FIG. 13, at step 159, as soon as the poker hand 119 is determined, the computer starts evaluating all possible 2,598,960 combinations in all possible permutations of the remaining 47 cards in the deck and all possible 32 combinations, in which the initial five cards 120-128 can be held, to calculate the probabilities of the winning categories as seen at step 173. Utilizing a powerful central processing unit ("CPU") and fast poker evaluation algorithms the CPU allocates awards to the winning categories at step 175. In step 177 and 179 is shown an alternative approach, in which the computer had pre-calculated and stored all contracts in a lookup table for faster retrieval. At step 161 the computer displays the two or more raising options and their contracts and the maximum pay back percentages achievable through an optimal play of the initially dealt five cards 120-128. At step 163, the player holds any of the originally displayed five cards 120-128 face up by depressing hold buttons 154, 156, 158, 160, and 162. In FIG. 9 the video screen 118 displays in areas 176 and 178 an overlay of columns 132-138 of FIG. 8 exemplary contracts to the player if he opts to raise his bet.

Figure 10:
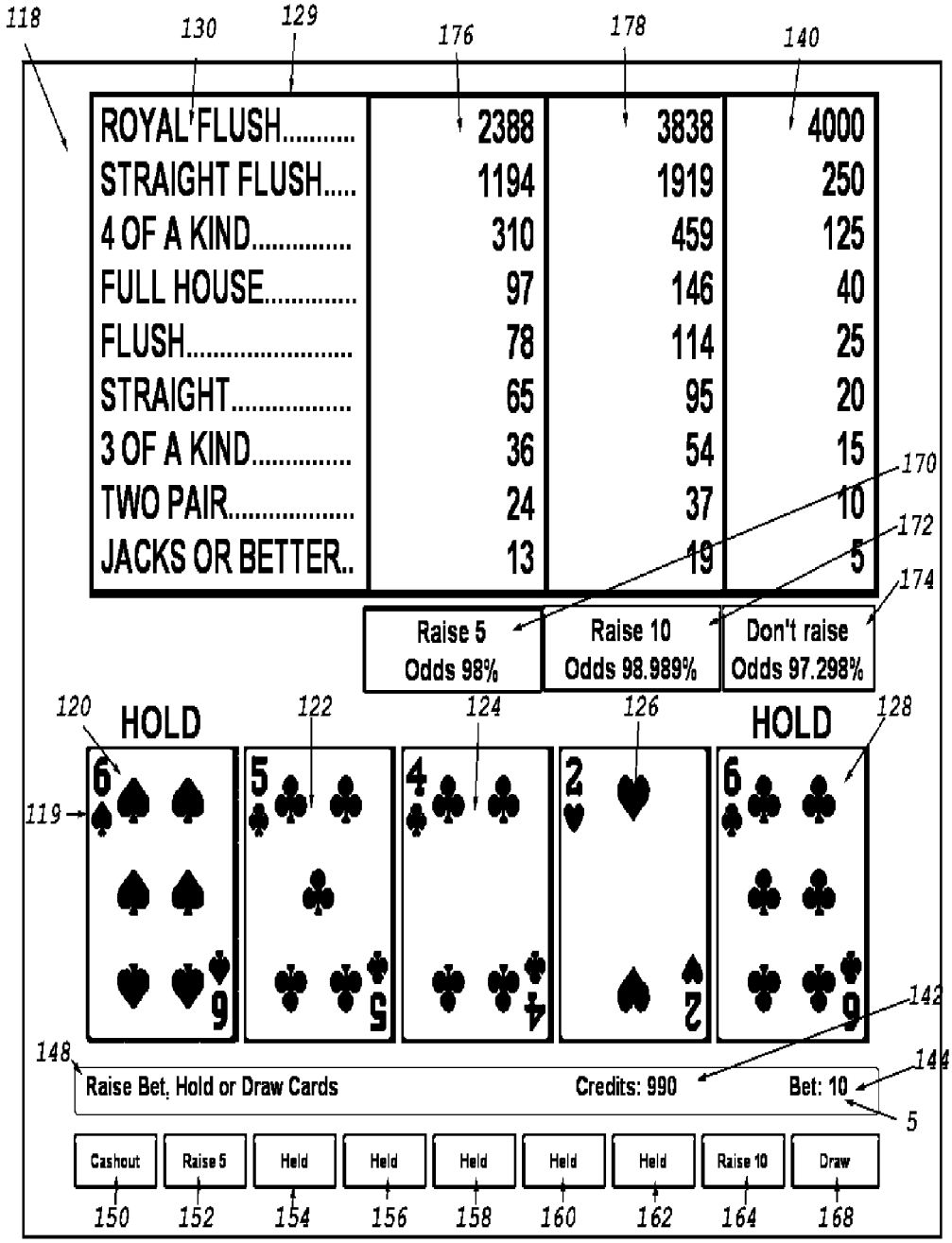
FIG. 10 is a display of the video screen after the player has chosen to raise his bet by 5 credits to 10 credits.
Figure 11:
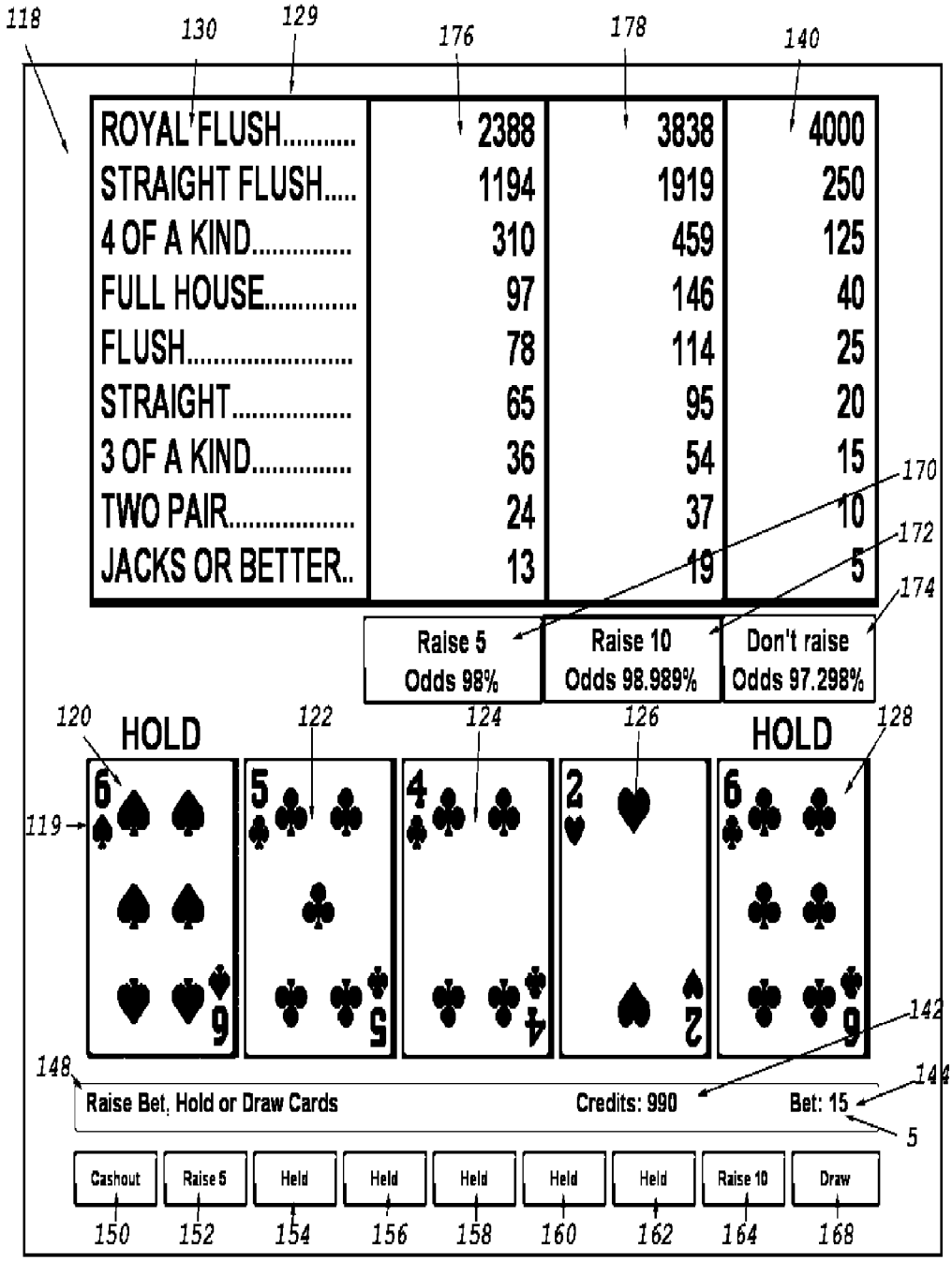
FIG. 11 is a display of the video screen after the player has chosen to raise his bet by 10 credits to a total of 15 credits.

At steps 165 and 167 the player can raise his initial bet by 5 or 10 as shown in FIG. 10 and FIG. 11. His total wager is not committed yet and is displayed in area 144; therefore it is not subtracted from his credits as displayed in area 142 until he makes his final decision. Evaluating his option as displayed by the original contract in area 140 or the raised bet contracts in areas 176 and 178, he can change the hold of the originally dealt cards 120-128, or defaults to his original contract. Below the columns are clearly displayed the required raise amounts in area 170 and 172 and the maximum pay back percentage achievable through an optimal play of the initially dealt poker hand by these contracts. The player can activate those contracts either by controls 152 or 164 on FIG. 10 or by touching areas 170 or 172 on a touch screen. Area 174 provides to the player an option to revoke his raise and return to his initial wager and default contract by touching it, which corresponds to step 169 in FIG. 13. Once the player has decided which cards he wants to hold and which contract he wants to play, he can then depresses the draw button 168 at step 171. Then the computer commits the wager and proceeds by replacing the cards that are not held with new cards from the randomly shuffled deck as seen in FIG. 12.

Figure 12:
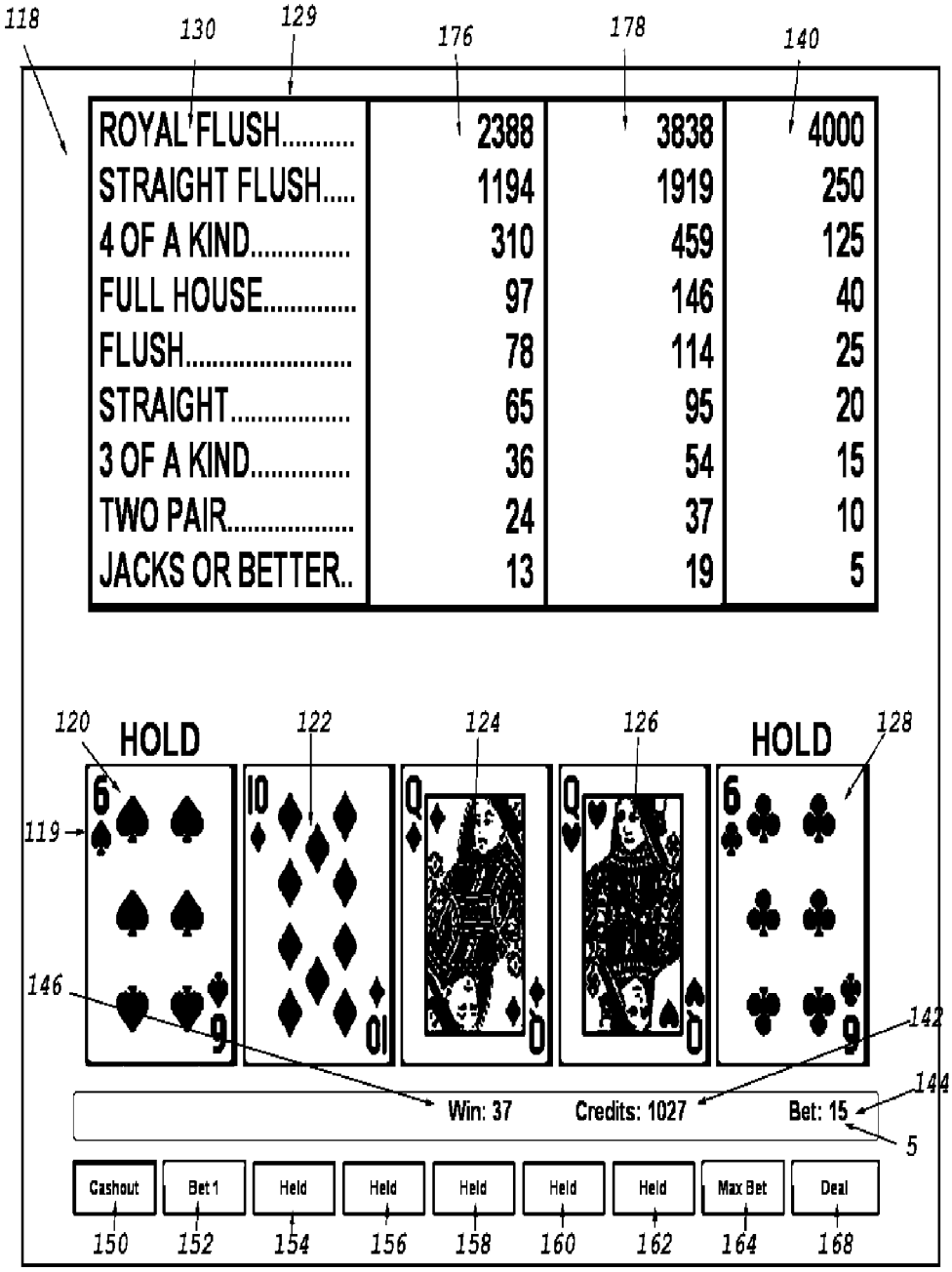
FIG. 12 is a display of the video screen of the final hand after the player has chosen to deal and replace the unheld cards with random cards from the deck.

Assuming that the player has raised his wager by 10 credits, his bet is 15 as displayed in area 144 in FIG. 12. His total credits had been reduced from 990 to 980 (not shown) by the amount of his additional raise. The unheld cards 122-126 had been replaced by new cards. At step 181 the computer evaluates that the player has Two Pair in his final hand. In this particular case the amount won is 37 credits according to contract 178. It is displayed in payout window 146 and is added to the player's credits in the amount of 1027 as shown in window 142 (990−10+37=1017). Should the player have risen by 5 credits, the bet in area 144 would've shown 10 credits. Then contract 176 would take effect and the computer would pay 24 credits. Finally, if the player had chosen to forfeit any raise option the bet in area 144 would've shown at the original value of 5 and the computer would've paid 10 credits according to the original contract 140.

As described above, the specific application was described as a form of poker. However, other games can be played such as keno, blackjack, slots or other games which are generally found at casinos.

Figure 14:
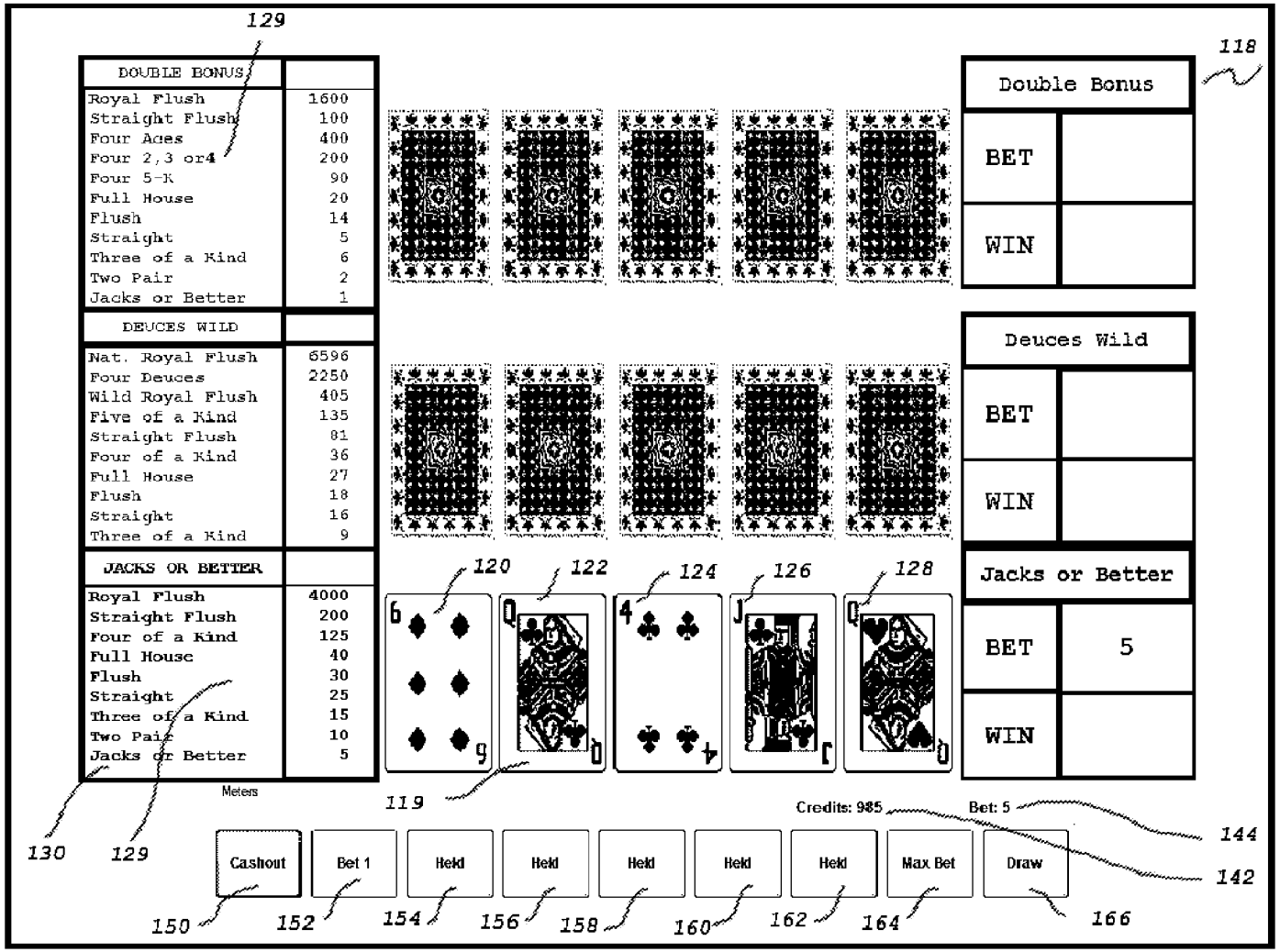
FIG. 14 is a display of the video screen of the alternate embodiment after the player has made a bet and the initial cards of the first poker hand are displayed.

Turning to FIG. 14, there is illustrated the alternate embodiment of the current invention applied to skilled games. By skilled game it is implied that the ability of the player influences the final results of the game by his actions. The exemplary game hereinafter described involves the linking of three different popular video poker games, namely Jacks or Better, Deuces Wild and Double Bonus Poker. In this alternate embodiment, when we refer to linking together different games, we refer to games that differ either in the total set of outcomes and/or the subset of paid outcomes and/or the rules by which the subset of the paid outcomes is chosen from the set of the total outcomes, which is represented in their pay table. Furthermore we mean games which are different rather than linking together different hands of the same game such as described in the earlier embodiment.

Video monitor 118 displays a typical Video Draw Poker Hand 119 that is comprised of five cards 120, 122, 124, 126 and 128. Initially only the backs of the cards 120-128 are displayed. The Jacks or Better contract 129 (Pay Table) is displayed adjacent to the Poker Hand 119. A first column 130 in contract 129 displays the names of the winning categories of the contract 129. The prize for a winning hand is displayed in column 131. Generally the cards are dealt from "standard" fifty-two card decks which may also include jokers.

There is also displayed an area 142 to show his credits and an area 144 to display the wager. All the available controls to the player 150-166 are displayed below. Control 150 allows the player to cash out his credits. Control 152 allows the player to bet one credit. Controls 154-162 allow the player to hold or discard respectively cards 120-128. Control 164 allows the player to bet the maximum allowable wager. Control 166 instructs the game to draw the cards.

Figure 15:
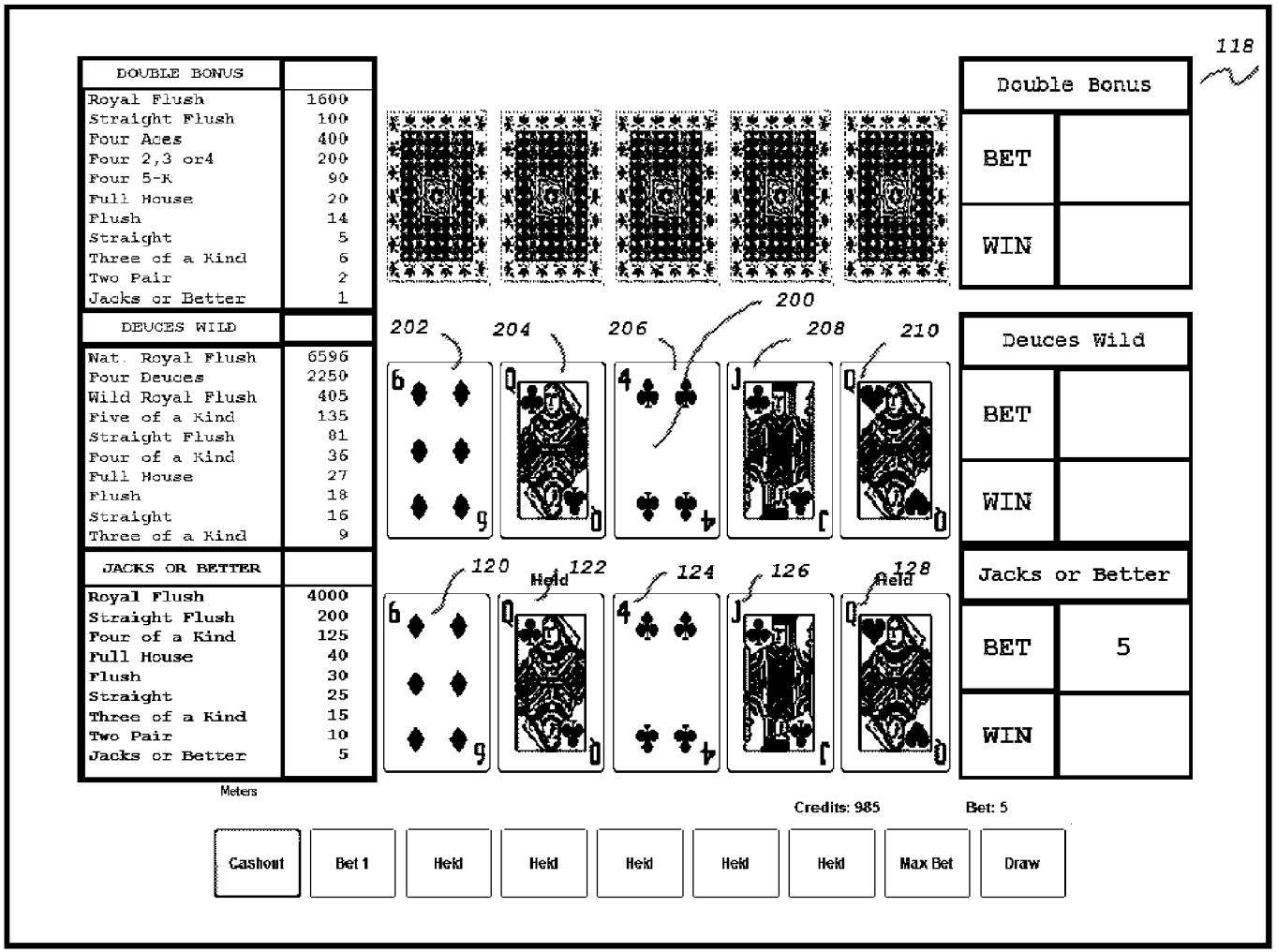
FIG. 15 is a display of the video screen after the player selected the cards to be held and shows the initial cards of the second poker hand.
Figure 16:
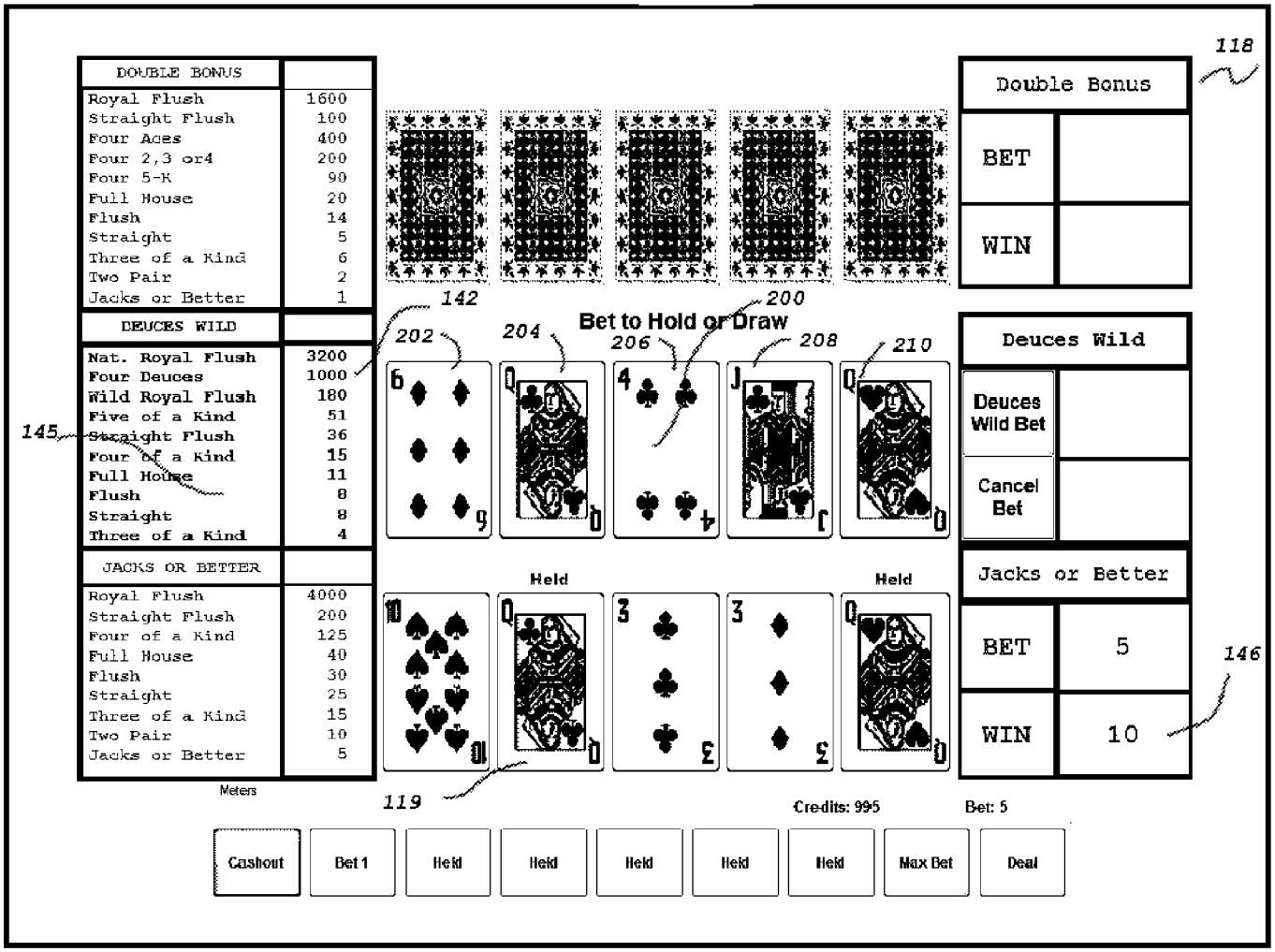
FIG. 16 is a display of the video screen after the player has drawn the cards not held in the first poker game with the final first hand displayed and the second pay table calculated.

Again looking at FIG. 14, the player bet 5 which reduced his credits from 990 to 985. At the next step as shown in FIG. 15, the player held two queens. At the same time as seen in FIG. 15, the same cards are dealt to hand 200, which contains cards 202, 204 206, 208 and 210. This game is Deuces Wild and the contract is displayed in window 145 with the awards displayed in window 147. Three new cards are drawn for the hand 119 as shown in FIG. 16. The player is awarded 10 credits for his winning hand of two pair as seen in the window 146.

Figure 17:
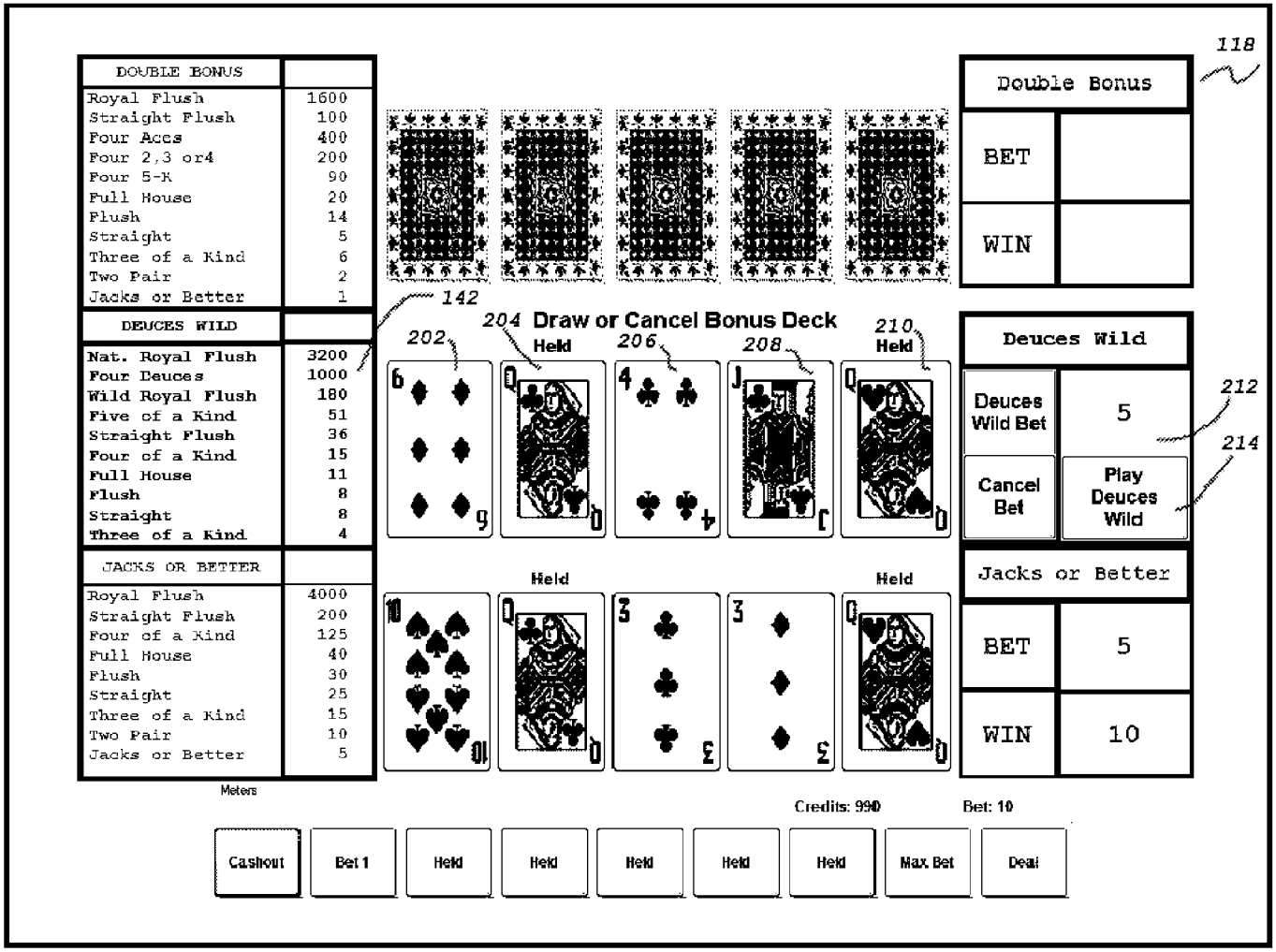
FIG. 17 is a display of the second poker hand after the player has made a bet and selected the cards to be held and which are to be discarded.
Figure 18:
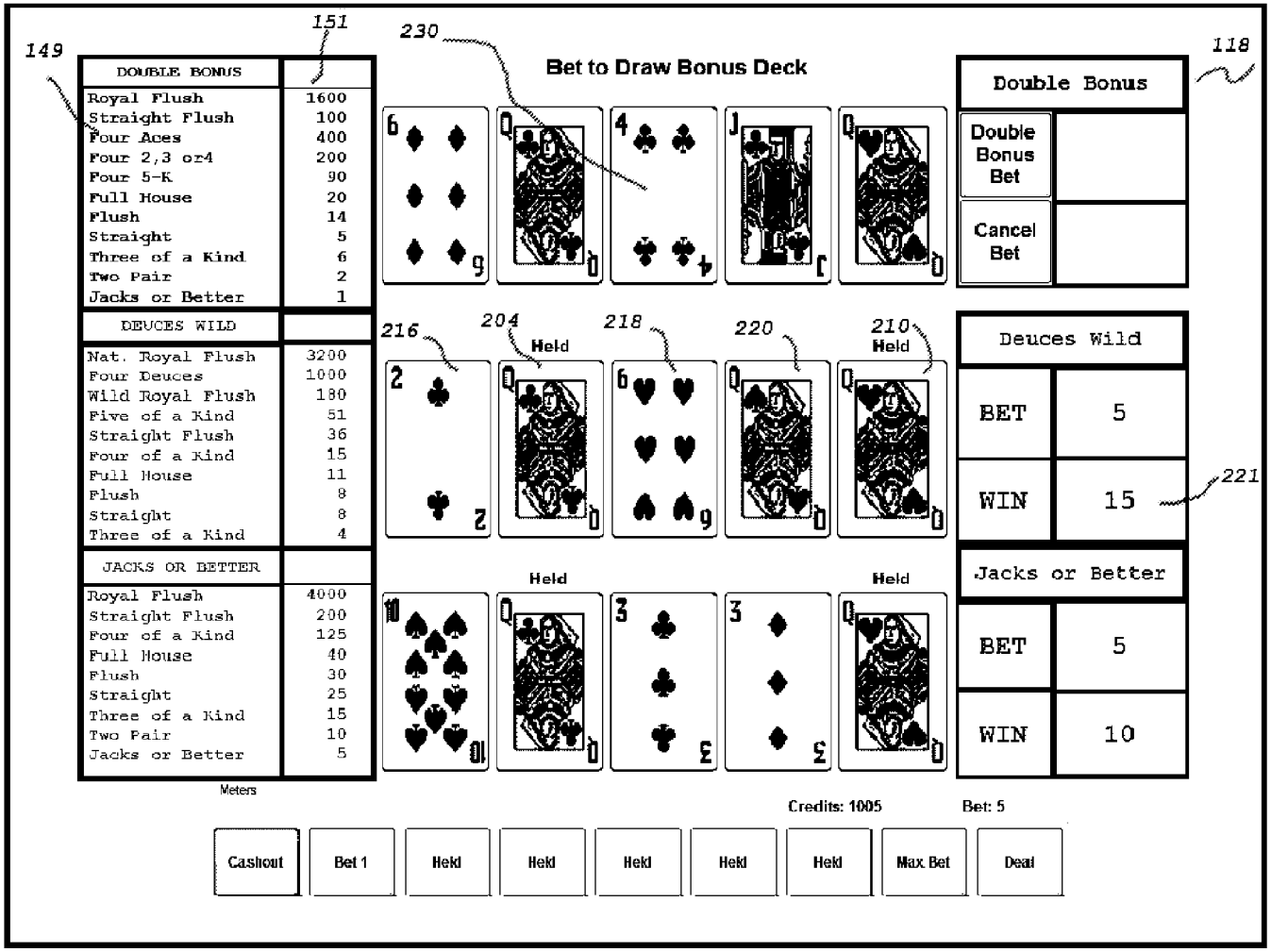
FIG. 18 is a display of the second poker after the discarded cards are replaced with drawn cards and the third poker hand displayed.

At this point the computer utilizing the powerful CPU and the fast poker algorithms (as described in the previous embodiments) calculates the possibilities of all winning hands and allocates awards to the winning hands as displayed in window 147 and player is offered the opportunity to bet on hand 200, the Deuces Wild game. It is observed that the awards displayed in window 147 have dropped from those displayed in FIG. 15 due to the fact that the hand already displays a pair of queens. The player decided to bet 5 credits as shown in FIG. 17 in window 212. The player is also given the opportunity to cancel his bet as seen in window 214. The player then selected cards 204 and 210 to be held and drew new cards 216, 218, and 220 as seen in FIG. 18. The credits won are displayed in window 221.

Figure 19:
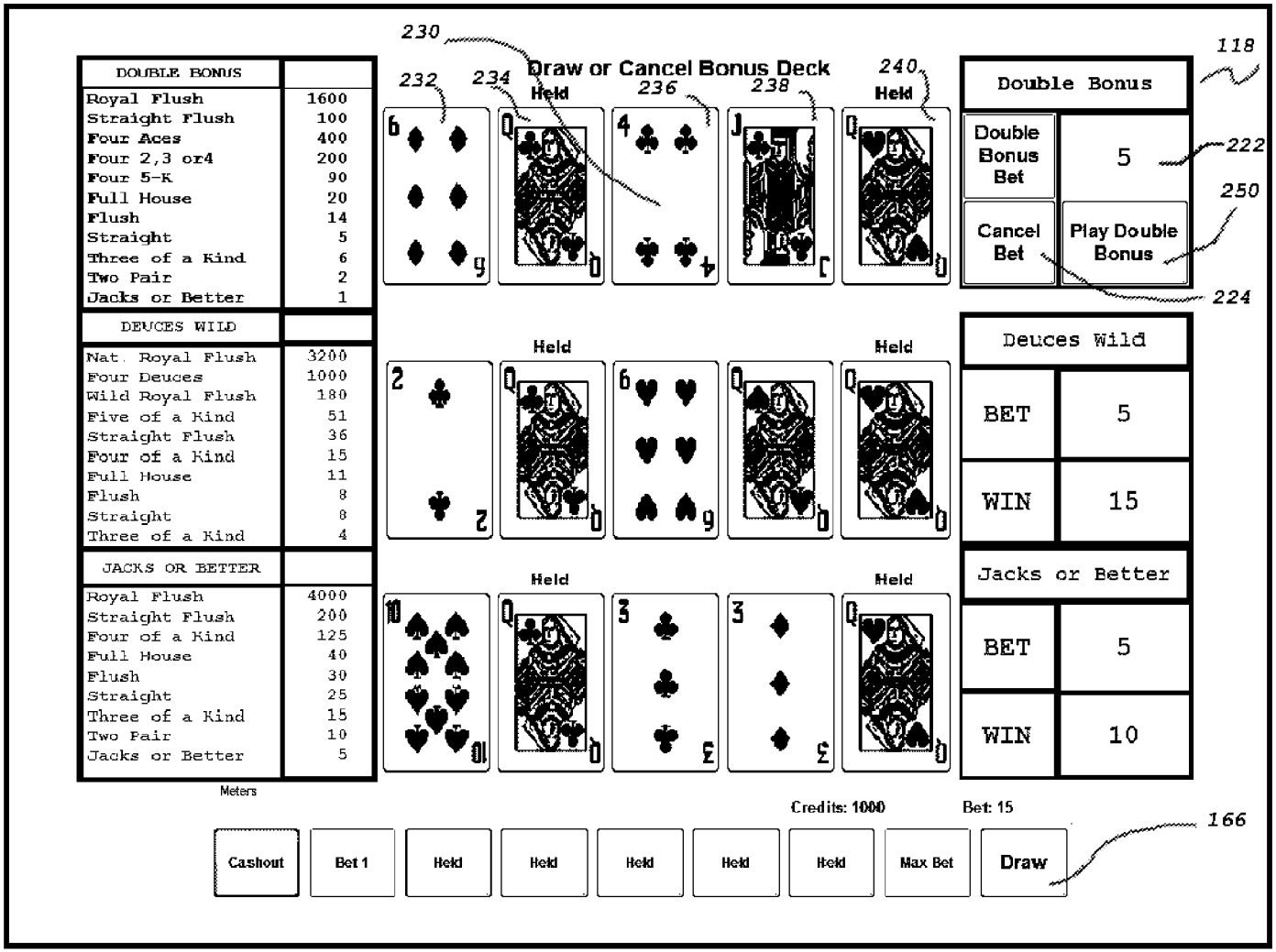
FIG. 19 is a display of the third poker hand after the player has made a bet and selected the cards to be held and which are to be discarded.
Figure 20:
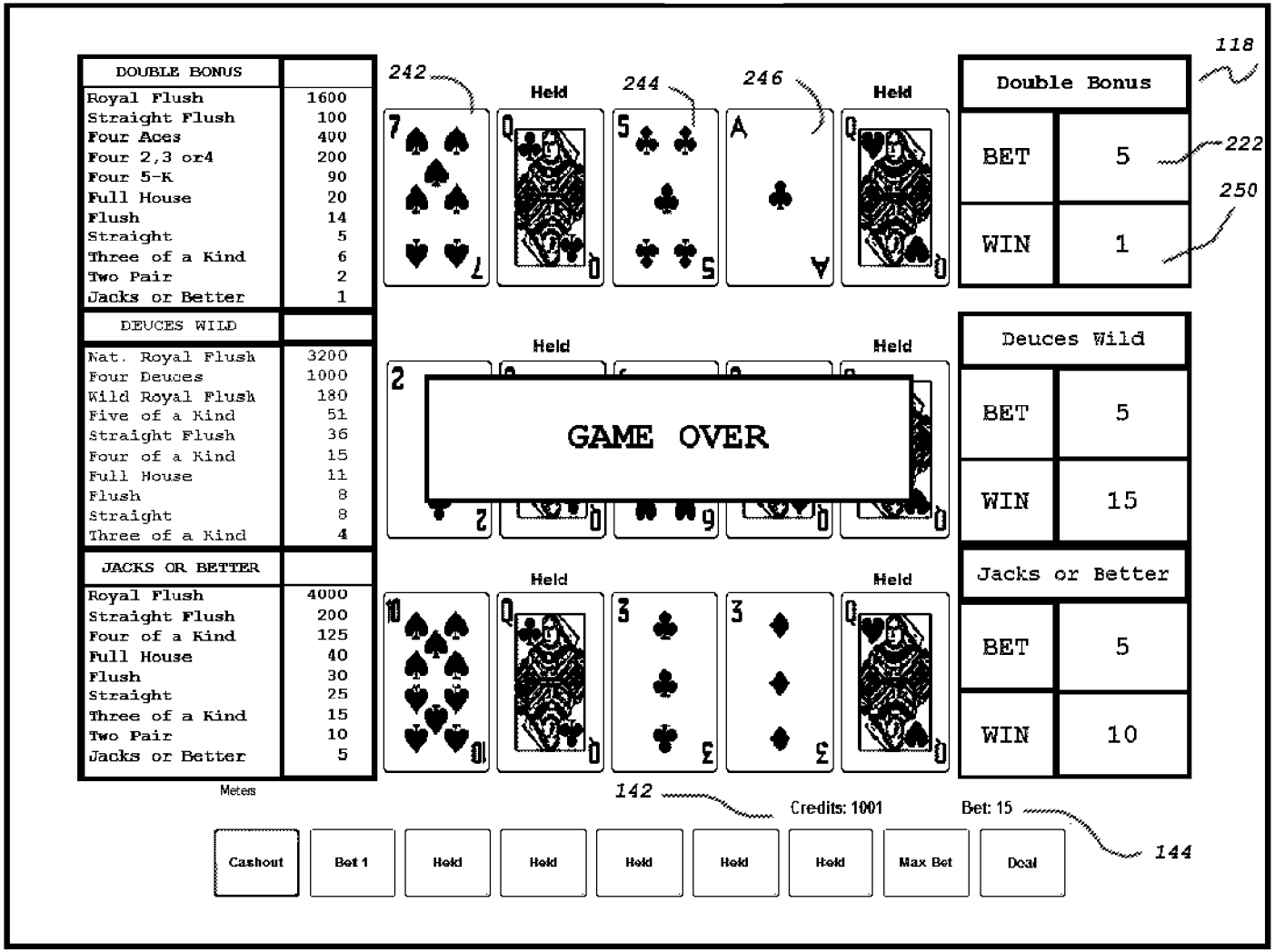
FIG. 20 is a display of the third poker hand after the discarded cards are replaced with drawn cards and the final third poker hand.

Simultaneously with the win being displayed, the third hand 230 is dealt by the computer. Window 149 displays the contract and window 151 displays the awards for the winning hands. As previously described the computer with the CPU allocates awards to the winning hands as displayed in the window 151. The cards comprising this hand are 232, 234, 236, 238 and 240. Again, in this example, these cards are identical to the hand 119. However, it should be kept in mind that other variations of the game can be devised such as a new hand is dealt that is independent of the first hand 119. At the time shown in FIG. 18, the player must decide if he wants to play the Bonus Hand or not. If he wants to play, then he must place a bet. As shown in FIG. 19, the player decided to place his bet which is shown in window 222. The player has an opportunity to cancel his bet as seen in window 224. The player then held cards 234 and 240. The player depresses the draw button 166 and three new cards, 242, 244, and 246 are dealt as seen in FIG. 20. The player had a pair of queens so he wins 1 credit that is displayed in window 250. The credits in window are also updated based in the player's winnings or losses. The total bet for all three games is also displayed in window 144.

The skill and rewards for each hand are displayed in the windows 131, 147 and 151 which gives the awards for each particular hand prior to the player deciding if he wants to play that hand. If he does not wish to play the next successive hand, he can just decide at the appropriate time to not play and end the game. This increases the enjoyment of the player in deciding if he wants to play the next successive game, which can be a different poker game than the previous game.

Thus there has been provided a casino game and wagering system that fully satisfies the objects and advantages set forth herein. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A casino slot wagering system which links together two or more card games comprising:

means for allowing a player to place a wager on a first game, the first game having at least three inputs comprising means for dealing a first hand, means for allowing the player to wager a first amount, and means for allowing the player to play the first game by selecting cards in the first hand;

a video display screen for displaying the first game;

means for displaying a first pay table having a first group of winning outcomes for the first game on the video screen;

means for determining the first group of winning outcomes for the first game and awarding the player an amount based on the first play table if the player played the first game means for displaying on the video screen a second game that is different than the first game after the first game is played, the second game having at least three inputs comprising means for dealing a second hand, means for allowing the player to wager a second amount, and means for allowing the player to play the second game by selecting cards in the second hand;

means for displaying a second pay table having a second group of winning outcomes for the second game on the video screen;

means for calculating the second pay table which is co-dependent on the calculated probabilities of the first pay table and calculated based on the probabilities of all possible winning combinations of the second game and on the common inputs of the first and second games;

the means for allowing the player to wager a second amount on the second game after the player has observed the second pay table;

means for determining the second group of winning outcomes for the second game and awarding the player an amount based on the second pay table if the player played the second game;

the three inputs for the first group and the three inputs for the second group having at least one input that is common for each of the groups and at least one input that is unique for each of the groups;

the first group of winning outcomes and the second group of winning outcomes having at least one winning or losing outcome that is the same for the first and second games and at least one different winning outcome for the first and second games.

2. The casino slot wagering system of claim 1 wherein one of the games is a poker game known as jacks or better.

3. The casino slot wagering system of claim 1 and further providing means for displaying on the video display screen a payback percentage for the second pay table based on the application of a mathematical optimization method that calculates the probabilities of all winning combinations and provides the pay back percentage to the player based upon the mathematical optimization method used.

4. The casino slot wagering system of claim 1 and further comprising:

means for displaying on the video screen a third game having a third group of wining outcomes that is different than the first or second games after the second game is played, the third group of winning outcomes having at least one winning or losing outcome that may be the same or different than the first and second group of winning outcomes and at least one outcome that is different than either the first group or the second group of winning outcomes;

means for displaying a third pay table for the third game on the video screen;

means for calculating the third pay table based on the probabilities of all possible winning combinations of the third game;

means for allowing the player to wager a third amount on the third game after the player has observed the third pay table;

third player input means for allowing the player to play the third game;

means for determining the third game and awarding the player an amount based on the third pay table if the player played the third game.

5. The casino slot wagering system of claim 4 and further providing means for displaying on the video display screen a payback percentage for the third pay table based on the application of a mathematical optimization method that calculates the probabilities of all winning combinations and provides the pay back percentage to the player based upon the mathematical optimization method used.

6. The casino slot wagering system of claim 1 wherein the first and second games are poker games and the first game comprises at least live initial cards, and the second game comprises at least five initial cards, the at least five initial cards for the first and second games being identical and the pay table for the second winning outcome has at least one winning outcome that is unique from the first pay table.

7. The casino slot wagering system of claim 4 where the first, second and third games are poker games and the first, second and third games all comprise at least five initial cards, and the at least five initial cards for the first, second and third games are identical and the pay table for the third winning outcome has at least one winning outcome that is unique from the first or second pay table.

8. A method of playing a video poker game comprising:

displaying a first poker hand of initial cards from a standard deck face up on a video screen, the first poker hand having at least three inputs comprising means for dealing a first hand, means for allowing the player to wager a first amount, and means for allowing the player to play the first poker hand by selecting cards in the first hand;

displaying a first pay table having a first group of winning outcomes on a video screen representative of the awards for the first poker hand;

a player electing to make or not make a wager on the poker hand, and playing the poker hand if the player made a wager;

awarding the player the appropriate award for a winning hand;

displaying a second poker hand having second poker hand initial cards face up on the video screen while the first poker hand is still being displayed the second poker hand having at least three inputs comprising means for dealing the second poker hand, means for allowing the player to wager a second amount, and means for allowing the player to play the second poker hand by selecting cards in the second poker hand;

calculating a second pay table for the second poker hand which is co-dependent on the calculated probabilities of the first pay table and calculated based on the probabilities of all possible winning hands that may be obtained from the second poker hand's initial cards and on the common inputs of the first and second poker hands;

displaying the second pay table having a second group of winning outcomes on the video screen representative of the awards for the second poker hand;

the first group of winning outcomes and the second group of winning outcomes having at least one common winning or losing outcome is the same for the first and second games and at least one different winning outcome for the same winning hand;

the player electing to make or not make a wager on the second poker hand, and playing the second poker hand if the player made a wager; and awarding the player the appropriate award for a winning second poker hand.

9. The method of claim 8 and the further step of:

displaying a third poker hand having third poker hand initial cards face up on the video screen while the second poker hand is still being displayed the third poker hand having a third group of wining outcomes of which at least one winning outcome that may be the same or different than the first or second group of winning outcomes and at least one outcome that is different than either the first group or the second group of winning outcomes;

calculating a third pay table for the third poker hand based on the probabilities of all possible winning hands that may be obtained from the third poker hand's initial cards;

displaying the third pay table on the video screen representative of the awards for the third poker hand;

the player electing to make or not make a wager on the third poker hand, and playing the third poker hand if the player made a wager; and awarding the player the appropriate award for a winning third poker hand.

10. The method claim 8 wherein the initial cards of the first poker hand are identical to the initial cards of the second poker hand.

11. The method of claim 9 wherein the initial cards for the first, second and third poker hands are identical.

12. The method of claim 9 and the further step of calculating the second and third pay tables based on the application of a mathematical optimization method that calculates the probabilities of all winning outcomes and providing the pay back percentage to the player based upon the mathematical optimization method used.

13. A method of playing video poker comprising:

(a) providing a computer and related computer program for a video poker game, the video poker game requiring a player to undertake a series of game playing actions;

(b) the player placing a wager on the first poker game;

(c) displaying a first pay table having a first group of winning outcomes corresponding to winning outcomes in the first poker game;

(d) displaying outcomes of the first poker game on a video screen;

(e) displaying a second poker game on the video screen, an initial set of cards being identical to an initial set of cards for the first poker game;

(e) calculating a second pay table having a second group of winning outcomes which is co-dependent on the calculated probabilities of the first pay table and calculated based on the probabilities of possible outcomes for the second poker game, the first group of winning outcomes and the second group of winning outcomes having at least one common winning or losing outcome and at least one unique winning outcome for the first and second poker games;

(f) displaying the second pay table on the video screen;

(g) allowing the player to wager on the second poker game after the player sees the initial set of cards for the second poker game and sees the second pay table;

(h) completing play of the second poker game;

(i) awarding the player an amount based on the second pay table if the player bet on the second poker game.

14. The method of claim 13 and further comprising the steps of:

(j) displaying a third poker game on the video screen, an initial set of cards for the third poker game being identical to the initial set of cards for the first and second poker games;

(k) calculating a third pay table having a third group of wining outcomes based on the probabilities of possible outcomes for the third poker game, the third group of winning outcomes having at least one winning outcome that may be the same or different than the first and second group of wining outcomes and at least one outcome that is different than either the first group or the second group of winning outcomes;

(l) displaying the third pay table on the video screen;

(m) allowing the player to wager on the third poker game after the player sees the initial set of cards for the third poker game and sees the third pay table;

(n) completing play of the third poker game;

(o) awarding the player an amount based on the third pay table if the player bet on the third poker game.

15. The method of claim 14 and the further step of displaying on the video screen a payback percentage for each possible winning outcomes for the second and third poker games based on the application of a mathematical optimization method that calculates the probabilities of all winning outcomes and providing the pay back percentage to the player based upon the mathematical optimization method used.

16. A casino slot wagering system comprising:

a video screen;

a first video game and a second video game played on the video screen, the first and second video games linked together by having either an identical game or by an identical pay table but not having both;

a first pay table having a first group of winning outcomes for the first game on the video screen;

first player input means for allowing the player to play the first game;

means for determining the first game and awarding the player an amount based on the first play table if the player played the first game;

a second pay table having a second group of winning outcomes for the second game on the video screen;

means for calculating the second pay table which is co-dependent on the calculated probabilities of the first pay table and calculated based on the probabilities of all possible winning combinations of the second game and on the commonality of the first and second games either being identical games or by their pay tables being identical;

means for allowing the player to wager a second amount on the second game after the player has observed the second pay table;

second player input means for allowing the player to play the second game;

means for determining the winning outcome for the second game and awarding the player an amount based on the second pay table if the player played the second game;

the first group of winning outcomes and the second group of winning outcomes having at least one winning outcome that is the same for the first and second games and at least one different winning outcome for the first and second games.

17. The casino slot wagering system of claim 16 wherein the first and second games are poker games knows as jacks or better.

18. The casino slot wagering system of claim 15 wherein the first and second games are poker games and the first game comprises at least five initial cards, and the second game comprises at least five initial cards, the at least five initial cards for the first and second games being identical and the pay table for the second winning outcome has at least one winning outcome that is unique from the first pay table.

19. The casino slot wagering system of claim 15 wherein the first and second games are poker games and the first game comprises at least five initial cards, and the second game comprises at least five initial cards, the at least five initial cards for the first and second games being different and the pay tables for the first and second games are identical.

* * * * *

UNITED STATES PATENT AND TRADEMARK OFFICE

CERTIFICATE OF CORRECTION

PATENT NO. : 9,251,664 B2
APPLICATION NO. : 13/632557
DATED : February 2, 2016
INVENTOR(S) : Ditchev It is certified that error appears in the above-identified patent and that said Letters Patent is hereby corrected as shown below:

In the claims,

In column 17, line 27, please delete the word "live" and insert the word --five--.

Signed and Sealed this
Seventeenth Day of May, 2016

Michelle K. Lee

Michelle K. Lee
*Director of the United States Patent and Trademark Office*